US009890011B2

(12) United States Patent
Tokuma

(10) Patent No.: US 9,890,011 B2
(45) Date of Patent: Feb. 13, 2018

(54) SHEET PROCESSING APPARATUS AND IMAGE FORMING APPARATUS

(71) Applicant: CANON KABUSHIKI KAISHA, Tokyo (JP)

(72) Inventor: Naoto Tokuma, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/210,127

(22) Filed: Jul. 14, 2016

(65) Prior Publication Data

US 2017/0036880 A1 Feb. 9, 2017

(30) Foreign Application Priority Data

Aug. 4, 2015 (JP) ..... 2015-154003

(51) Int. Cl.

| | |
|---|---|
| ***B65H 43/00*** | (2006.01) |
| ***B65H 31/02*** | (2006.01) |
| ***B65H 45/18*** | (2006.01) |
| ***B65H 31/26*** | (2006.01) |

(52) U.S. Cl.

CPC ..... *B65H 43/00* (2013.01); *B65H 31/02* (2013.01); *B65H 31/26* (2013.01); *B65H 45/18* (2013.01); *B65H 2301/4213* (2013.01); *B65H 2301/42146* (2013.01); *B65H 2301/42194* (2013.01); *B65H 2403/942* (2013.01); *B65H 2511/11* (2013.01); *B65H 2511/20* (2013.01); *B65H 2511/22* (2013.01); *B65H 2515/84* (2013.01); *B65H 2701/1752* (2013.01); *B65H 2701/18292* (2013.01); *B65H 2801/27* (2013.01)

(58) Field of Classification Search

CPC ..... B65H 43/00; B65H 31/26; B65H 45/18; B65H 31/02; B65H 2511/11; B65H 2301/42194; B65H 2403/942; B65H 2515/84; B65H 2511/20; B65H 2511/22; B65H 2301/4213; B65H 2301/42146; B65H 2701/18292; B65H 2701/1752; B65H 2801/27

See application file for complete search history.

(56) References Cited

U.S. PATENT DOCUMENTS

| | | | |
|---|---|---|---|
| 8,613,442 | B2 | 12/2013 | Gamo et al. |
| 8,752,837 | B2 | 6/2014 | Iwata et al. |
| 8,794,617 | B2 | 8/2014 | Tokuma |
| 8,851,468 | B2 | 10/2014 | Tokuma |
| 9,033,330 | B2 | 5/2015 | Tokuma |

(Continued)

FOREIGN PATENT DOCUMENTS

| | | | |
|---|---|---|---|
| JP | 10-181988 | A | 7/1998 |

*Primary Examiner* — David H Bollinger

(74) *Attorney, Agent, or Firm* — Fitzpatrick, Cella, Harper & Scinto

(57) ABSTRACT

A control portion controls a distance H and/or a shift amount L1 such that a relationship of L<H≤L+L1 holds, where L is a length of each sheet among the sheet bundle in the conveyance direction, H is a distance from the conveyance roller pair to an end regulation member in the conveyance direction, and L1 is a shift amount between a first sheet among the sheet bundle and a second sheet adjacent the first sheet. The second sheet is conveyed toward the end regulation member by the conveyance roller pair in the state in which the leading edge of the preceding sheet is in contact with the end regulation member.

19 Claims, 15 Drawing Sheets

(56) References Cited

U.S. PATENT DOCUMENTS

| | | | | |
|---|---|---|---|---|
| 9,067,753 | B2 | 6/2015 | Tokuma et al. | |
| 9,102,497 | B2 | 8/2015 | Tokuma | |
| 2010/0116975 | A1* | 5/2010 | Brossi | B65H 29/04 250/223 R |
| 2010/0276878 | A1* | 11/2010 | Bichsel | B65H 29/00 271/264 |
| 2012/0275839 | A1 | 11/2012 | Kushida et al. | |
| 2012/0288310 | A1 | 11/2012 | Kamiya et al. | |
| 2014/0054854 | A1* | 2/2014 | Kushida | B65H 29/22 271/306 |
| 2015/0307305 | A1* | 10/2015 | Saito | B65H 43/00 271/3.19 |
| 2015/0310316 | A1* | 10/2015 | Osada | G06K 15/16 358/1.12 |
| 2016/0116881 | A1* | 4/2016 | Kodama | B65H 43/00 358/498 |
| 2016/0303886 | A1* | 10/2016 | Umeda | B42C 1/125 |

* cited by examiner

SHEET PROCESSING APPARATUS AND IMAGE FORMING APPARATUS

BACKGROUND OF THE INVENTION

Field of the Invention

The present invention relates to a sheet processing apparatus performing such processes of aligning and binding a plurality of sheets and to an image forming apparatus employing the same.

Description of the Related Art

A sheet processing apparatus requires a certain processing time in general in performing a process including a binding process or the like on sheets. This processing time exceeds, in most cases, a sheet discharge interval of the sheets discharged out of an image forming apparatus, and it is difficult to complete the binding process or the like within the sheet discharge interval.

Hitherto, in order not to drop productivity of an image forming process by interrupting the image forming process, a method of retaining the first several sheets after the beginning of the process and making them temporarily stand by during the process is widely adopted as 'buffering'. Japanese Unexamined Patent Application Publication No. 10-181988 discloses a buffer unit configured such that a plurality of sheets fed from an upstream conveyance path is sequentially wound around a roller having a large diameter while shifting leading edges thereof so as to overlap with each other. The buffer unit then discharges the plurality of wound sheets to a downstream conveyance path in response to an output signal.

In terms of an amount of the shift among the sheets during the buffering operation, it is difficult to align the both sheets in a conveyance direction if the sheet (lower sheet) closer to a tray surface (supporting surface) of a processing tray is shifted upstream more than the sheet (upper sheet) more distant from the tray surface. Meanwhile, it is difficult to convey a plurality of sheets while precisely superposing edges of the sheets. Thus, a target value of the shift amount is set in general such that the lower sheet proceeds downstream with respect to the upper sheet. The shift amount among the sheets is set to be around 3 to 10 mm in general and to be constant during the buffering operation in the document described above and other known apparatuses.

For instance, in a case of a saddle stitching binding process (saddle processing), sheets are released onto a processing tray from a discharge roller pair. A certain sheet processing apparatus is provided with an inertia alignment system in which the sheets or the sheet bundle formed by the buffering operation are abutted against a leading edge regulating member on the processing tray and are aligned by the gravity acting on the sheet or the sheet bundle and by inertia given them in discharging operation.

Still further, there is another aligning system for aligning buffered sheets in which the lower sheet is conveyed to abut against the leading edge regulating member at first, and then the upper sheet is aligned by an alignment member such as a paddle. In the case of this aligning system, because it is necessary to align only the upper sheet, the alignment member is preferred to be a sliding member performing aligning operation while sliding on the upper side of the sheets, like the paddle, rather than a nipping member nipping the sheets. Therefore, it is difficult to increase force for aligning the sheet.

Next, an inter-stack time during which a processing operation is performed will be described. In a case of not performing buffering operation, the inter-stack time is determined by subtracting a conveyance time equivalent to a sheet length from a time interval from a leading edge of a preceding sheet to a leading edge of a succeeding sheet (referred to as Top-to-Top hereinafter) which is determined by productivity of each system. That is, the inter-stack time is expressed by Top-to-Top−L/V, where L is a sheet conveyance length and V is a sheet conveyance speed. In a case of performing the buffering operation, since the preceding sheet is retained to overlap with the succeeding sheet, the inter-stack time may be expressed as 2×Top-to-Top−L/V. Thus, it can be seen that the inter-stack time increases. Because the sheet length in the case of performing the buffering operation is a length of the overlapping sheets (a length of the sheet bundle), sheet conveyance length equals the sum of the original sheet length L and the buffering shift amount. That is, the larger the buffering shift amount, the shorter the inter-stack time is. Since this is not preferable for the original purpose of assuring a processing time, the buffering shift amount has been preferred to be as small as possible.

As illustrated in FIG. 15A, when sheets S1 and S2 are conveyed while overlapping with each other (buffering conveyance), a pasting force Fa is generated between the sheets. When sheets with a fine surface and having a high smoothness such as a coated sheet, a film, and an OHP sheet are buffered, air between the sheets is eliminated by a force bringing the sheets close to each other such as a nip pressure of a conveying roller pair for example. That is, the sheets are put into a vacuum-like condition by which the sheets are stuck on each other. In this case, the pasting force Fa becomes very large. In the case of the coated sheet or the like where pasting force Fa is large, pasting force Fa is overwhelmingly larger than an aligning force Fb (inertia force in the inertia alignment system for example) of the inertia alignment system or the alignment system employing the slide returning member. Therefore, alignment accuracy is partially lost as illustrated in FIG. 15B even after performing the alignment operation, leading to degradation of quality of resultant products.

It is desirable to perform the buffering operation from aspects of avoiding drop of productivity and of assuring the inter-stack time. However, it has been difficult to align the sheets as described above in buffering the smooth sheets such as the coated sheet, the film, and the OHP sheet. Still further, even in a case of a plain sheet whose surface is not treated, it is conceivable that pasting force Fa between the sheets increases to drop the alignment accuracy when environmental humidity is high or concentration of an output image is high (in a case of a solid coated image for example). Then, many apparatuses have been configured not to perform the buffering operation and while accepting the drop of productivity by pausing the image forming process during the processing operation.

SUMMARY OF THE INVENTION

According to one aspect of the present disclosure, a sheet processing apparatus includes a sheet overlap processing portion configured to form a sheet bundle in which a plurality of sheets to be processed overlap each other while being shifted from each other, a conveyance roller pair configured to convey the sheet bundle formed by the sheet overlap processing portion, a sheet supporting portion supporting the sheet bundle conveyed by the conveyance roller pair, and an end regulation member configured to abut with and regulate a downstream end, in a conveyance direction of the conveyance roller pair, of the sheet bundle supported on the sheet supporting portion. The sheet processing apparatus further includes a control portion configured to control a distance H and/or a shift amount L1 such that a relationship of $L<H\leq L+L1$ holds, where L is a length of each sheet among the sheet bundle in the conveyance direction, H is a distance from the conveyance roller pair to the end regulation member in the conveyance direction, and L1 is a shift amount between a first sheet among the sheet bundle and a second sheet adjacent to the first sheet among the sheet bundle.

According to another aspect of the present disclosure, a sheet processing method includes steps of making a first sheet and a second sheet overlap each other such that the first sheet precedes in a sheet conveyance direction with respect to a second sheet adjacent the first sheet, aligning the first sheet and the second sheet by conveying the first sheet and the second sheet overlapping each other along the conveyance direction of the conveyance roller pair such that a downstream end in the conveyance direction abuts against an end regulation member, and processing the first and second sheets aligned by the aligning step. The aligning step includes a separating step of conveying the second sheet toward downstream in the conveyance direction by the conveyance roller pair in a state in which an upstream end in the conveyance direction of the first sheet is discharged from the conveyance roller pair and the downstream end of the first sheet is in contact with the end regulation member, so as to relatively move the second sheet with respect to the first sheet.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

An image forming apparatus of the present disclosure will be described below with reference to the drawings. This image forming apparatus includes a sheet processing apparatus configured to align and process sheets discharged onto a processing tray in a discharge direction, and may be a copier, a printer, a facsimile, or a multifunction printer for example. In the following description, a monochromatic/color copying machine (refers to as 'copier', hereinafter) 1000 will be exemplified and described as the image forming apparatus.

Figure 1:
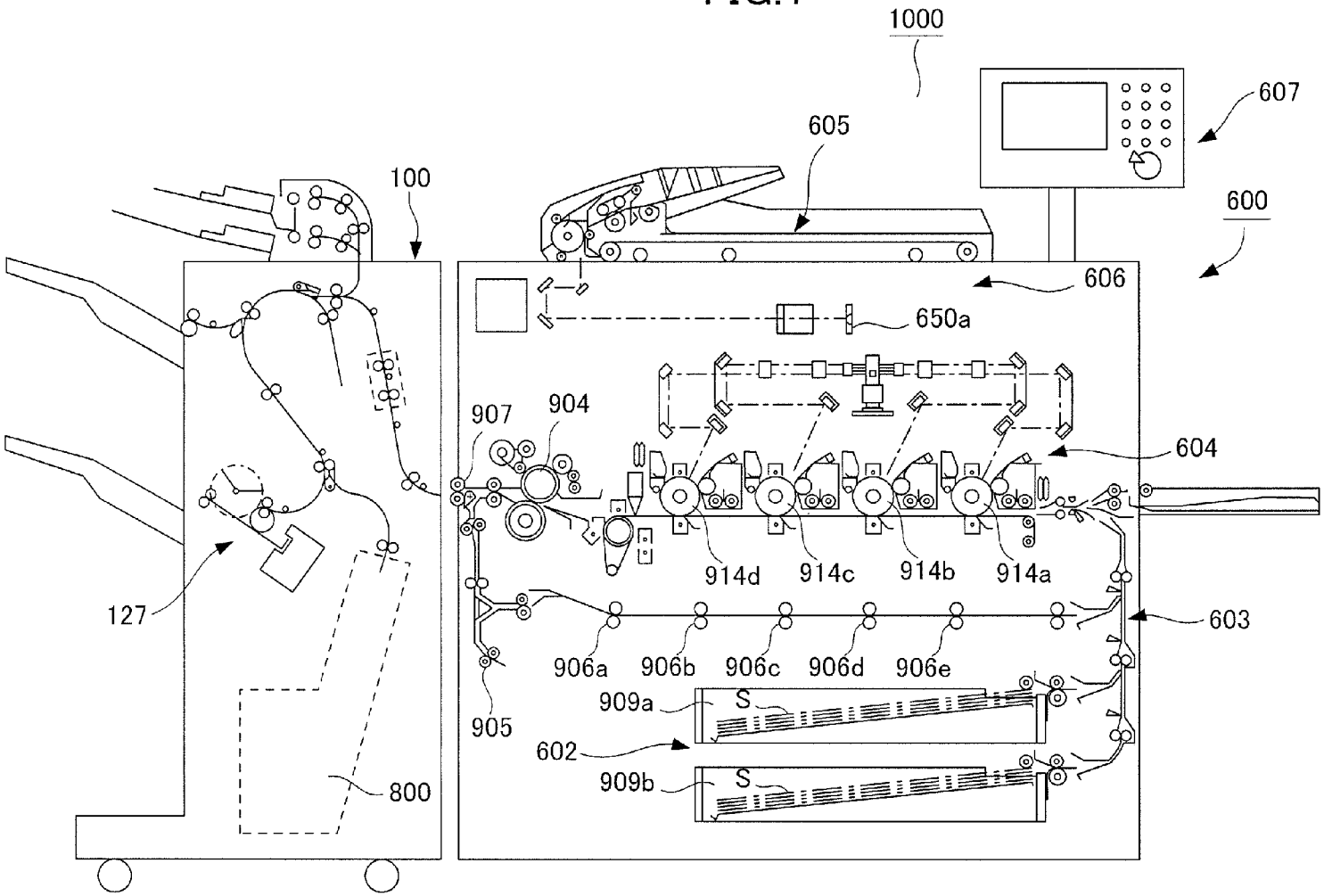
FIG. 1 is a section view schematically illustrating a copier, i.e., an image forming apparatus, including a sheet processing apparatus of the present disclose.
Figure 2:
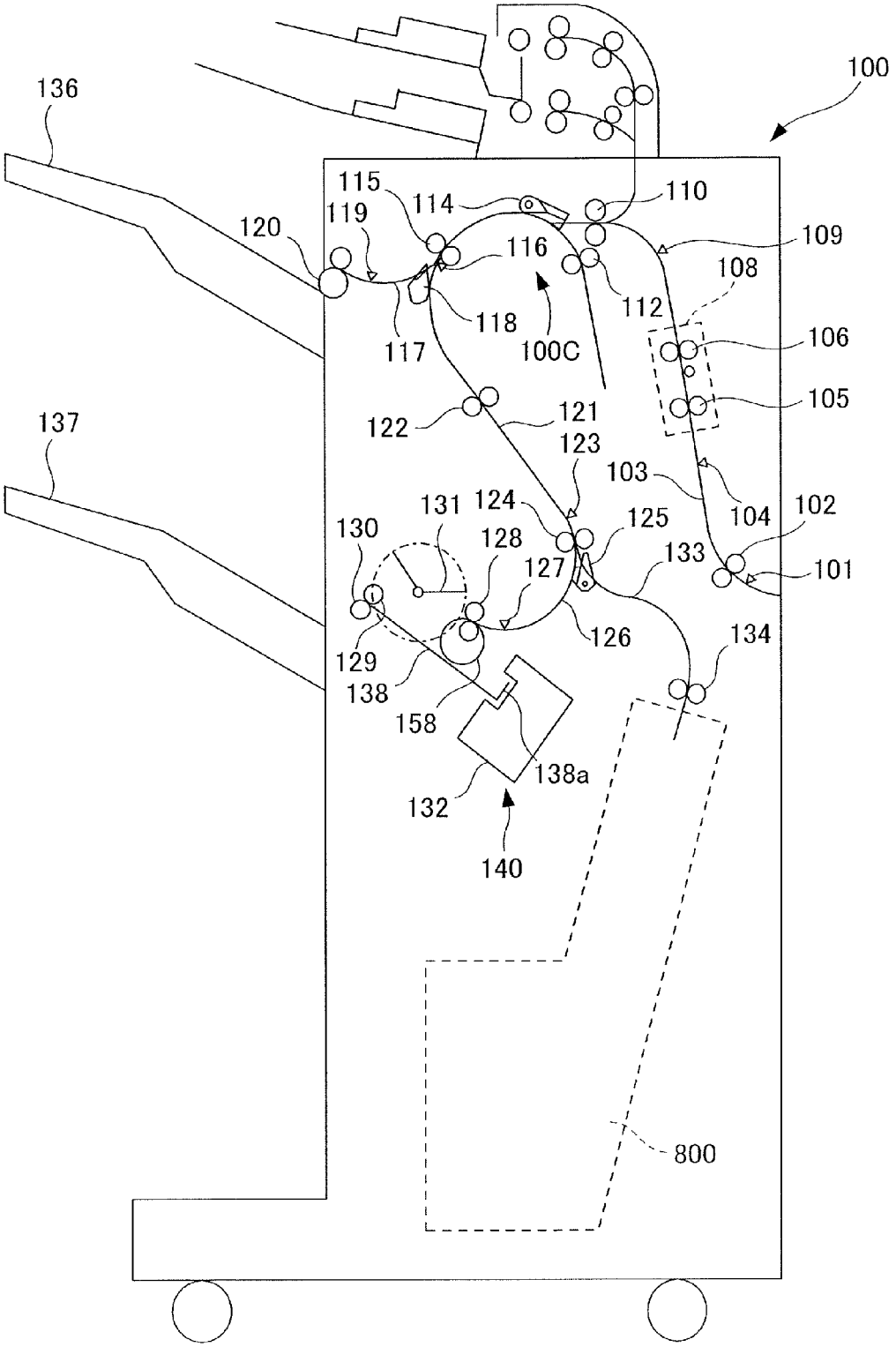
FIG. 2 is a section view schematically illustrating a finisher.

FIG. 1 is a sectional view schematically illustrating the copier 1000 of the present embodiment. FIG. 2 is a section view schematically illustrating a finisher 100, i.e., a sheet processing apparatus of the present embodiment. As shown in FIG. 1, the copier 1000 includes a copier body 600 and the finisher 100. The finisher 100 of the present embodiment is detachably attached to the copier body 600 which serves as a copier by itself. In other words, the finisher 100 is an optional attachment of the copier body 600. It is noted that while the detachable finisher 100 will be described in the present embodiment, the finisher 100 and the copier body 600 may be integrated as a single unit. That is, both the copier body to which the finisher is attached as the optional device and the copier body into which the fisher is integrally assembled are examples of the image forming apparatus.

The copier body 600, i.e., a body of the image forming apparatus, includes a sheet storage portion 602, a sheet feeding portion 603 feeding a sheet S stored in the sheet storage portion 602, and an image forming portion 604 forming an image on the sheet S fed by the sheet feeding portion 603. The copier body 600 also includes an operation portion 607 to be operated by a user in setting the sheet. The operation portion 607 is a discrimination portion discriminating sheet information such as a basis weight, classification of a coated or non-coated sheet, a length in a sheet conveyance direction, and a width in a width direction orthogonal to the sheet conveyance direction. The copier body 600 further includes a document feeder 605 feeding a document and an image reader 606 reading image information from the document fed by the document feeder 605. The sheet storage portion 602 includes cassettes 909*a* and 909*b* each storing the sheet S. The sheet S stored in the cassettes 909*a* and 909*b* is fed to the image forming portion 604 at a predetermined timing by the sheet feeding portion 603. The image forming portion 604 includes photosensitive drums 914*a*, 914*b*, 914*c*, and 914*d* on which color toner images of yellow, magenta, cyan, and black are formed, respectively, and is configured to transfer the respective color toner images formed on the respective photosensitive drums onto the sheet S. Thus, an unfixed toner image is formed on the sheet S. Then, the unfixed toner image is fixed by a fixing unit 904, and the sheet S is discharged to the finisher 100 by a discharge roller 907. It is noted that in a case of duplex printing, the sheet S is reversed by a reverse roller 905, and the reversed sheet S is conveyed to the image forming portion 604 again by conveyance rollers 906*a*, 906*b*, 906*c*, 906*d*, 906*e*, and 906*f* provided along a reverse conveyance path. Then, the abovementioned image forming operation is repeated again. Meanwhile, in a case of forming an image of image information of the document described above, the image information of the document fed from the document feeder 605 is read by the image reader 606. Then toner images corresponding to the image information are formed on the photosensitive drums 914*a*, 914*b*, 914*c*, and 914*d*, and are transferred onto the sheet S, and are fixed on the sheet S.

A basic operation of the finisher (sheet processing apparatus) 100 will now be described. The finisher 100 is connected downstream of the copier body 600 and is configured to receive a plurality of sheets S fed from the copier body 600 and to perform a stapling process in a stapling processing portion 140, a saddling process in a saddle processing portion 800. As illustrated in FIG. 2, the sheet S fed from the copier body 600 is passed to an inlet roller pair 102 of the finisher 100. At this time, an inlet sensor 101 simultaneously detects a passing timing of the sheet S. A lateral registration detection sensor 104 detects an end position of the sheet S conveyed by the inlet roller pair 102 and passing through a conveyance path 103, i.e., an upstream conveyance path. The lateral registration detection sensor 104 detects a transverse registration error of the sheet S with respect to a center position.

In response to the detection of the lateral displacement detected by the lateral registration detection sensor 104, a shift unit 108 conducts a shift operation (referred to also as a 'transverse registration detection process' hereinafter) of the sheet S being conveyed by shift roller pairs 105 and 106 by moving by a predetermined amount in a front/back direction. After finishing the shift operation conducted by the shift unit 108, the sheet S is conveyed by a conveyance roller pair 110. The sheet S conveyed by the conveyance roller pair 110 is conveyed downstream further by a buffer roller pair 115. In a case where the sheet S is to be discharged to an upper stacking tray 136, an upper path switch member 118 moves toward an upper path conveyance path by a driving member such as a solenoid not illustrated. Thereby, the sheet S is lead to an upper path 117 and is discharged onto the upper stacking tray 136 by an upper discharge roller pair 120. It is noted that a buffering process (sheet overlap process) conducted by a buffer processing portion 100C will be described later.

Meanwhile, in a case where the sheet S is not discharged to the upper stacking tray 136, the upper path switch member 118 is moved a position of a solid line indicated in FIG. 2. Thereby, the sheet S is lead to and passes through a stack conveyance path 121, i.e. a downstream conveyance path, by a buffer roller pair 122 and a stack conveyance roller pair 124. In a case where a saddle stitching binding process (saddle processing) is to be performed on the sheet S, a saddle path switch member 125 is moved to a saddle path 133 side by a driving member such as a solenoid not illustrated. Then, the sheet S is conveyed to the saddle path 133 and is lead to a saddle processing portion 800, i.e., a saddle unit, by an inlet roller pair 134 to undergo the saddle stitching binding process (saddle processing). It is noted the saddle processing conducted by the saddle processing portion 800 will be described later.

In a case where no saddle stitching binding process (saddle processing) is to be conducted, the saddle path switch member 125 is moved to a position of a solid line indicated in FIG. 2. In a case where a binding process is to be conducted, the sheet S conveyed by the stack conveyance roller pair 124 is sequentially conveyed onto a processing tray 138 of a stapling processing portion 140 to conduct the binding process by a stapler 132. In a case where no binding process is to be conducted by the stapling processing portion 140, the sheet S is discharged onto a lower stacking tray 137 without going through the processing tray 138.

The stapling processing portion 140 includes a sheet detecting sensor 127 and a discharge roller 128 disposed along the stapler path 126. A knurled belt 158 is nipped by the discharge roller 128 and is disposed so as to be in contact with the processing tray (sheet supporting portion) 138. The processing tray 138 is inclined moderately with an approximately horizontal angle and is provided with an erectable leading edge stopper 138*a*, i.e., an end regulation member, at a lower end side thereof. The processing tray 138 is also provided with a lower roller 130 that can be normally and reversely driven at an upper end thereof and an upper roller 129 driven to open/close with respect to the lower roller 130 by an arm so as to be in contact with/separate from the lower roller 130. The upper roller 129 and the lower roller 130 compose a conveyance roller pair having a nip in a state when the upper roller 129 is closed. A paddle 131 in which a plurality of flexible members radially extend is disposed behind the discharge roller 128 so as to come into contact with the processing tray 138. A stapler 132 is disposed on the leading edge stopper 138*a* side (the lower end) of the processing tray 138.

The sheet conveyed through the stapler path 126 is discharged out of the discharge roller 128 onto the processing tray 138. At this time, the paddle 131 is located at its home position not in contact with the sheet, and the upper roller 129 is located at an open position separated from the lower roller 130. In a case when the sheet is a long sheet, a leading edge of the sheet projects out of the lower roller 130, and is discharged such that the sheet hangs on the lower stacking tray 137. A trailing edge of the sheet is guided by the knurled belt 158 and is lead to the processing tray 138. When the sheet detecting sensor 127 detects the trailing edge of the sheet, the paddle 131 is driven and the upper roller 129 moves to a close position. Then, the upper roller 129 and the lower roller 130 rotate reversely. Thereby, the sheet on the processing tray 138 is pulled into a direction opposite to the direction in which the sheet is discharged by the discharge roller 128. That is, the trailing edge of the sheet becomes a leading edge, and the sheet abuts against the leading edge stopper 138*a* erecting on the processing tray 138 by being conveyed by the paddle 131 and the knurled belt 158, i.e., sliding alignment members. In the same manner, a predetermined number of sheets discharged onto the processing tray 138 are conveyed toward the leading edge stopper 138*a*. Then, the respective sheets abut against the leading edge stopper 138*a* and are thus aligned as an aligned sheet stack. In this state, the leading edge stopper 138*a* recedes from the processing tray 138 and the binding process is conducted by the stapler 132. The bound sheets (sheet bundle) is moved back to the side of the roller pair 129 and 130 by a rear-pushing member not illustrated and is discharged by the rotating roller pair 129 and 130 onto the lower stacking tray 137.

Figure 3:
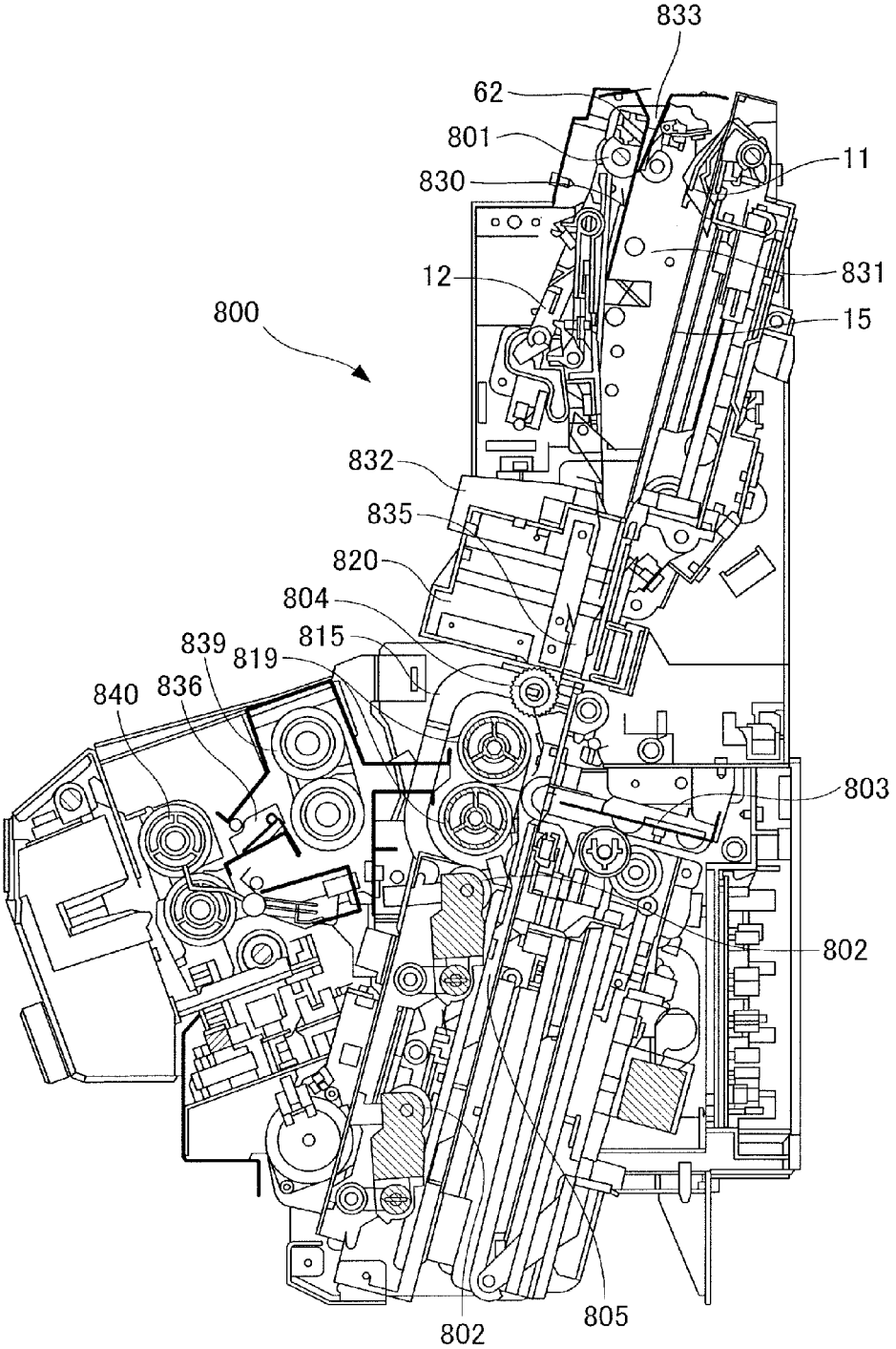
FIG. 3 is a section view illustrating a saddle processing portion.
Figure 4:
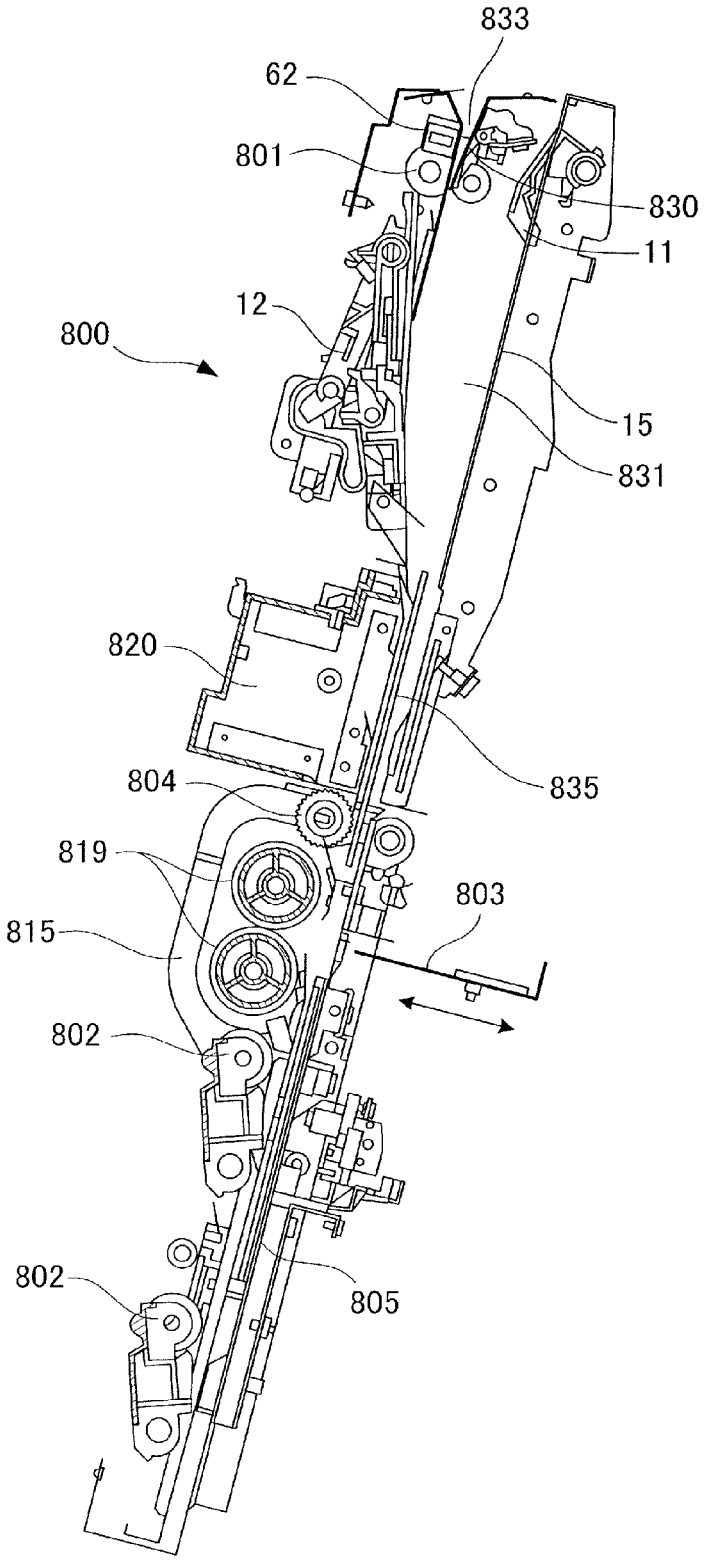
FIG. 4 is a section view illustrating a sheet supporting portion (processing tray) of the saddle processing portion.

Next, the saddle processing portion 800 will be described with reference to FIGS. 3 through 6E. As illustrated in FIGS. 3 and 4, the saddle processing portion 800 includes a processing tray 15, i.e., a sheet supporting portion, of a steep angle close to verticality, that is, an approximately vertical angle. A space 831 is formed upstream of and above the processing tray 15. A conveying-in path 833 is partitioned from the space 831 by a guide 830 and is formed on one side, i.e., on a side of the saddle body 832, of an upper side (left side in FIGS. 3 and 4) of the space 831. A saddle inlet sensor 62 and an inlet roller pair 801, i.e., a conveyance roller pair, are disposed sequentially from upstream along the conveying-in path 833, and a push member 12 is disposed from a position where the guide 830 is terminated. The push member 12 is configured to be movable in a direction coming into contact with/separating from the processing tray 15 by a link mechanism. The push member 12 stays at a stand-by position erecting on the saddle body 832 side in receiving the sheet and moves to an operating position urging the sheet to another side, i.e., to the processing tray 15 side, when the trailing edge of the sheet passes through the inlet roller pair 801.

A swingable pressure member 11 is disposed on an upstream side of the processing tray 15. The pressure member 11, whose tip is hooked, presses a trailing edge (upstream end) of the sheet pushed down to the processing tray 15. An intermediate part and a downstream part of the processing tray form a passage 835 having a narrow vertical width for guiding a predetermined number of sheets. A stapler 820, an intermediate roller 804, an alignment plate 815, an alignment roller 802, and a leading edge stopper 805, i.e., an end regulation member, are sequentially disposed along the passage 835 from upstream to downstream. The intermediate roller 804 and the alignment roller 802 are configured to convey the sheet or the sheet stack on the processing tray 15 and the alignment plate 815 is configured to move in a direction orthogonal to a sheet conveyance direction to align a side edge of the sheet. The leading edge stopper 805 is movable in a vertical direction along the processing tray 15 and abuts against the leading edge (downstream end) of the sheet discharged onto the processing tray 15 to align a position in the conveyance direction (vertical direction) of the sheet. The stapler 820 binds the sheet stack on the processing tray 15 by a plurality of widthwise points at a middle position in a lengthwise direction.

A folding plate 803 is disposed beneath the processing tray 15 and on a downstream of the intermediate roller 804, and a folding roller pair 819 is disposed within the saddle body 832, i.e., on the side opposite from the processing tray 15. The folding plate 803 is configured to move across the processing tray 15, and the folding roller pair 819 is configured to nip the sheet bundle folded in two by the folding plate 803 and to convey while gripping the sheet bundle folded in two (see FIG. 5). The saddle body 832 is provided with a conveyance path 836 extending in a transverse direction and conveying the folded sheet bundle. Conveyance roller pairs 839 and 840 are disposed along the conveyance path 836. The sheet bundle that has undergone through the saddle stitching binding process (saddling process) is discharged out of the conveyance path 836 on a stacking tray not illustrated.

Figures 6A, 6B, 6C, 6D, 6E:
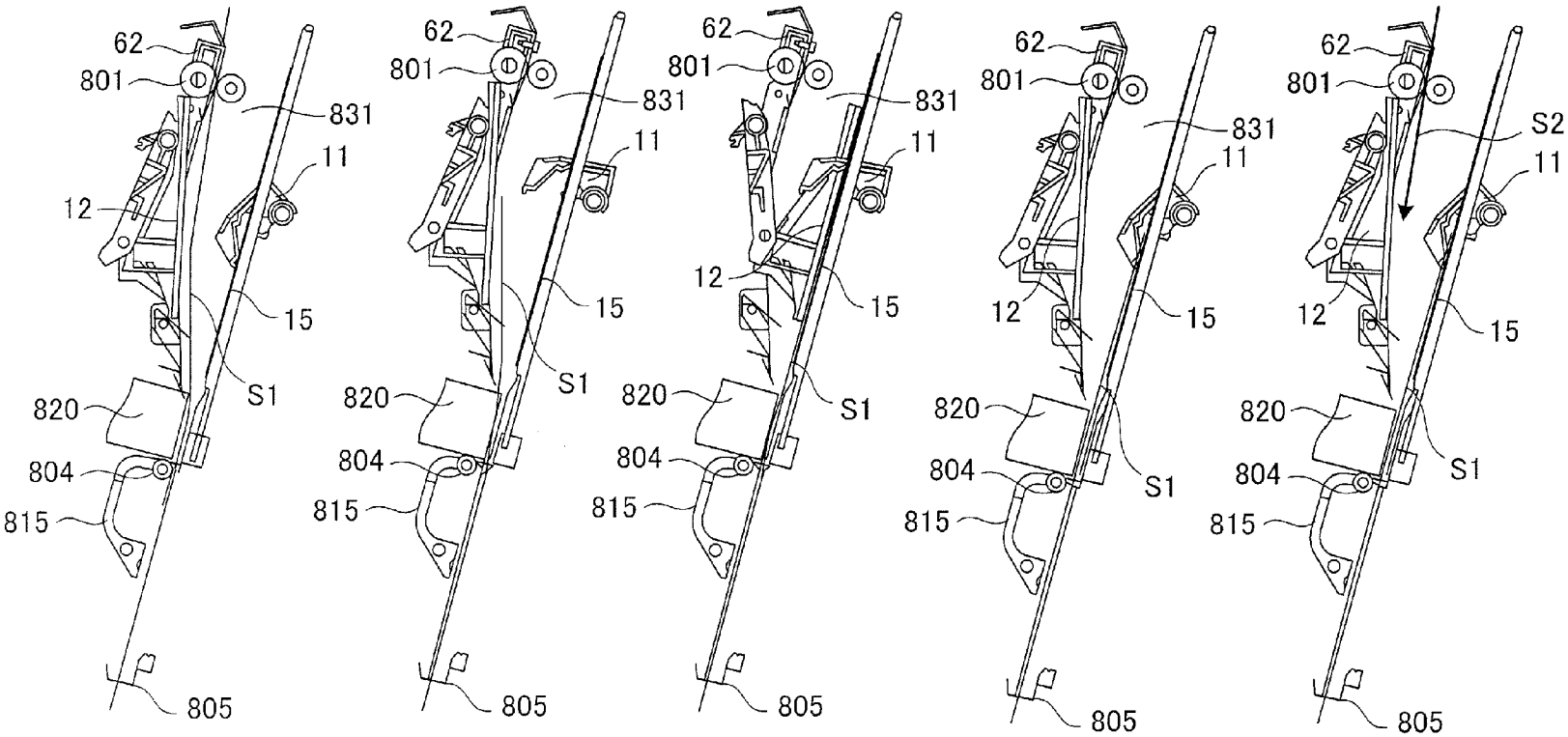
FIG. 6A is a schematic diagram illustrating a first stage of a sheet aligning operation.
FIG. 6B is a schematic diagram illustrating a second stage of the sheet aligning operation.
FIG. 6C is a schematic diagram illustrating a third stage of the sheet aligning operation.
FIG. 6D is a schematic diagram illustrating a fourth stage of the sheet aligning operation.
FIG. 6E is a schematic diagram illustrating a fifth stage of the sheet aligning operation.

Next, a basic operation of the saddle processing conducted by the saddle processing portion 800 will be described with reference to FIGS. 6A through 6E. The sheet lead from the saddle path 133 (see FIG. 2) to the saddle processing portion (saddling unit) 800 is released by the inlet roller pair 801 so as to head toward the leading edge regulation member along the passage 835. At this time, as illustrated in FIG. 6A, the push member 12 is located at the stand-by position erecting along the saddle body 832 and the pressure member 11 is located at its stand-by position of the closed state in which the tip thereof is in contact with the processing tray 15. Still further, the leading edge stopper 805 is held at its stand-by position such that a middle part of the sheet corresponds to a binding position of the stapler 820, and the alignment plate 815 is located at its stand-by position separated from the sheet side edge. In the state when the downstream end (leading edge) of the preceding sheet S1 passes through the inlet roller pair 801, the preceding sheet S1 abuts against the leading edge stopper 805 and is aligned in the conveyance direction of the preceding sheet S1 due to the gravity of the sheet owing to the steep inclination of the processing tray 15 and to inertia of the sheet caused by the release of the sheet by the inlet roller pair 801. Still further, the alignment plate 815 moves in the direction orthogonal to the conveyance direction to align the sheet in the width direction.

As illustrated in FIG. 6B, when the saddle inlet sensor 62 detects that the upstream end (trailing edge) of the preceding sheet S1 has passed through the inlet roller pair 801 and the guide 830, the pressure member 11 moves from the stand-by position to the open position. Still further, as illustrated in FIG. 6C, the push member 12 moves from the stand-by position to the processing tray 15 side and moves the upstream end (trailing edge) side of the preceding sheet S1 onto the processing tray 15. In this state, as illustrated in FIG. 6D, the pressure member 11 is moved back again to the close position, i.e., the stand-by position, and presses the upstream end (trailing edge) of the sheet S so as to be placed on the processing tray 15. The push member 12 is returned back again to the stand-by position, i.e., the erecting position.

In this state, as illustrated in FIG. 6E, a next sheet S2 is conveyed into the conveying-in path 833 by the inlet roller pair 801. Then, similarly to the preceding sheet S1, the succeeding sheet S2 abuts a leading edge of the sheet against the leading edge stopper 805 on the processing tray 15, is aligned in a width direction of the sheet by the alignment plate 815, and is aligned with the preceding sheet S1. An operation of forcibly urging the preceding sheet S1 so as to press against the processing tray 15 to avoid the leading edge of the succeeding sheet S2 from hitting against the trailing edge of the preceding sheet S1 will be referred to as a trailing edge sorting hereinafter (see Step S204 in FIG. 13A).

Figure 5:
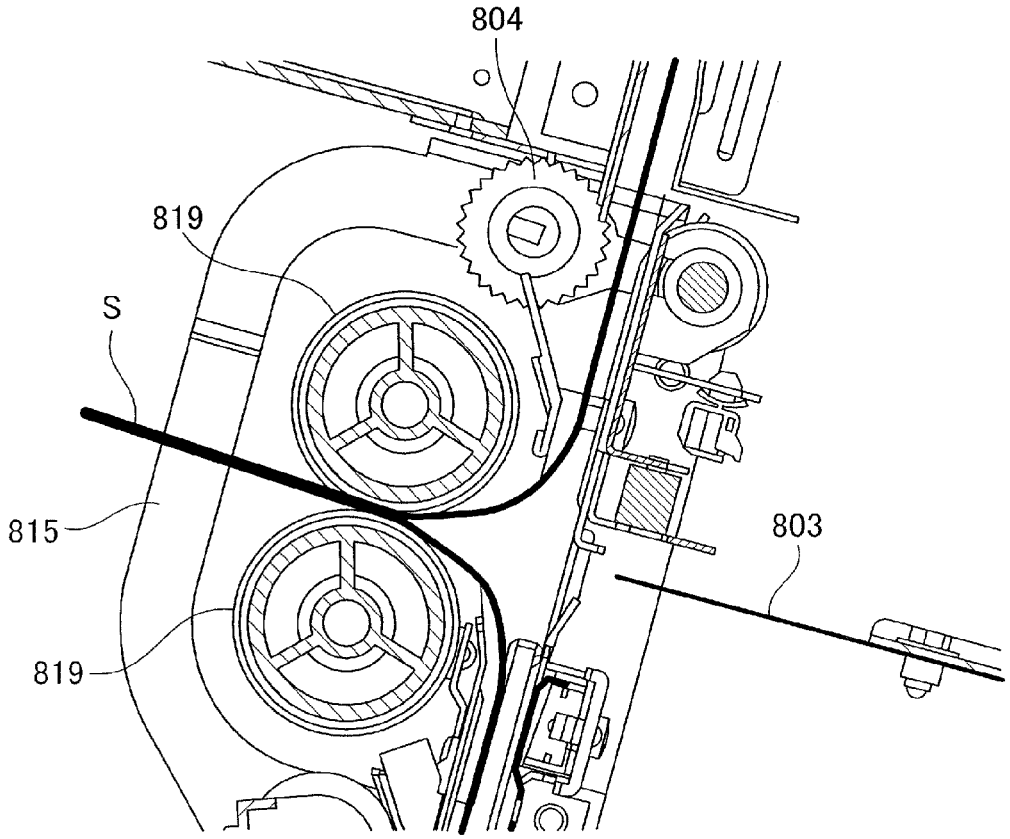
FIG. 5 is an enlarged section view of the saddle processing portion.

As described above, a predetermined number of sheets is aligned on the processing tray 15 while sorting the trailing edges to form a sheet stack composed of the predetermined number of sheets. The sheet stack abuts against and is aligned by the leading edge stopper 805 (end regulation member) located at an upper position and is bound by the stapler 820 in this condition. The leading edge stopper 805 is lowered by a predetermined amount so as to move to a lower position in this condition and to assist such that the sheet bundle is moved altogether to the leading edge stopper 805 by the intermediate roller 804 and the alignment roller 802. The sheet bundle is positioned by stopping the leading edge stopper 805 at a position where a binding position at a middle part of the sheet bundle corresponds to the folding plate 803. In this condition, the folding plate 803 is moved to project as illustrated in FIG. 5 such that the middle part of the sheet bundle is gripped by the nip of the folding roller pair 819. The folding roller pair 819 grips and conveys the sheet bundle while folding in two at the binding position, i.e., the middle part of the sheet bundle. The sheet bundle folded in two is conveyed further through the conveyance path 836 by the conveyance roller pairs 839 and 840 and is discharged on to the stacking tray.

Figure 7A:
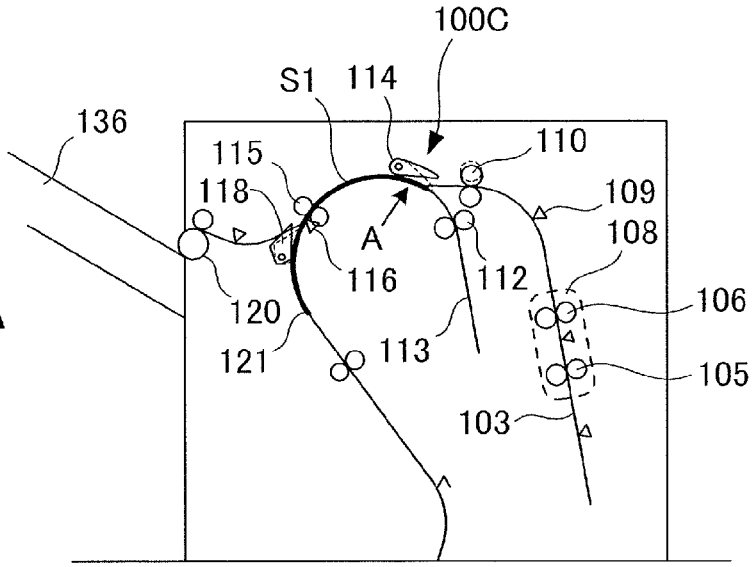
FIG. 7A is a schematic diagram illustrating a first stage of buffering operation (an overlap processing operation).

Succeedingly, a buffer processing portion 100C, i.e., a sheet overlap processing portion, that functions in the binding process conducted by the stapling processing portion 140 and in the saddling process conducted by the saddle processing portion 800 will be described with reference to FIGS. 7A through 7C. Because a certain period of time is required in conducting the binding process or the saddle stitching and double folding process in the stapling processing portion 140 and the saddle processing portion 800 described above, the sheet on which an image has been formed is temporarily retained in the buffer processing portion 100C within the finisher 100 during those process. In order to temporarily retain the preceding sheet on which the image has been formed, the buffer processing portion 100C, i.e., the sheet overlap processing portion, makes the preceding sheet, i.e., a first sheet, and a succeeding sheet, i.e., a second sheet adjacent to the first sheet, overlap each other so as to form a sheet bundle. This arrangement makes it possible to continuously form images without interrupting the image forming operation of the copier body 600 or to continue the image forming process with a short interrupt period of time at least as compared to a case in which no sheet is buffered. This arrangement makes it also possible to continuously convey the sheets on which the images have been formed to the finisher 100 at processing intervals of the copier body 600 itself or at intervals close to that intervals and thus to prevent productivity of the copier body 600 from dropping.

The buffer processing portion 100C includes a stack conveyance path 121 to which the sheet whose lateral registration and aligning process has been conducted by the shift unit 108 is conveyed by the conveyance roller pair 110 from the conveyance path 103 and a buffer path 113, i.e., a branched path, branched from a connecting part, i.e., a branch portion, of the conveyance path 103 and the stack conveyance path 121. A buffer switch member 114 is disposed at the connecting part (A). The buffer switch member 114 switches the sheet fed from the conveyance path 103 to a first position leading to the stack conveyance path 121 and to a second position leading the sheet from the stack conveyance path 121 to the buffer path 113. The stack conveyance path 121 includes a buffer roller pair 115, i.e., a first roller pair, capable of rotating normally and reversely and a second buffer sensor 116. A second buffer roller pair 112, i.e., a second roller pair, capable of rotating normally and reversely is disposed along the buffer path 113. It is noted a first buffer sensor 109, i.e., a sensor for sheet overlap processing portion, is disposed upstream of the conveyance roller pair 110 of the conveyance path 103. During the buffering process, the upper path switch member 118 is located at a position of a solid line in FIGS. 2 and 7A and the sheet will not be lead to the upper path 117 (see FIG. 2).

Next, an operation of the buffering process conducted by the buffer processing portion 100C will be described. The stapling processing portion 140 (binding processing portion) and the saddle processing portion 800 conduct the operation such as the binding process requiring a certain period of time and primarily retain (or buffer) the sheets on which the images have been formed and fed from the copier body 600 at predetermined intervals in the buffer processing portion 100C. The binding process is actuated when the first buffer sensor 109 detects the leading edge of the preceding sheet S1 to be retained. The buffer switch member 114 is held at a first position indicated by a solid line in FIG. 7A, and the preceding sheet S1 is conveyed by the conveyance roller pair 110 from the conveyance path 103 to the stack conveyance path 121. The buffer sensor 116 detects the leading edge of the preceding sheet S1 in the stack conveyance path 121. Thereby, a position of a trailing edge (downstream end) of the preceding sheet S1 is detected from a sheet size recognized in advance or a conveyance elapsed time of the first buffer sensor 109 and the buffer sensor 116. As illustrated in FIG. 7A, the preceding sheet S1 is conveyed by the buffer roller pair 115 until when the sheet trailing edge (downstream end) passes over the branch portion A.

When the trailing edge of the preceding sheet S1 passes over the branch portion A, the buffer switch member 114 is changed over to the second position indicated by a broken line. As illustrated in FIG. 7B, the preceding sheet S1 is reversely conveyed by when the buffer roller pair 115 reversely rotates. Then, the preceding sheet S1 reversely conveyed by from the trailing edge as a head by the buffer switch member 114 located at the second position is lead to the buffer path 113. Then, the preceding sheet S1 is conveyed to the buffer path 113 by the second buffer roller pair 112. During the reverse conveyance of the preceding sheet S1, the buffer sensor 116 detects timing when the trailing edge of the preceding sheet S1 passes through and the buffer sensor 116 is turned off. Then, a predetermined reverse conveyance amount is calculated from the timing, and the second buffer roller pair 112 is stopped. In this condition, the preceding sheet S1 is set such that a predetermined length at the leading edge side during the normal conveyance of the preceding sheet S1 (the trailing edge side during the reverse conveyance) is left on the stack conveyance path 121. When the leading edge during the reverse conveyance of the preceding sheet S1 passes through the branch portion A, the buffer switch member 114 is changed over to the first position.

Figure 7B:
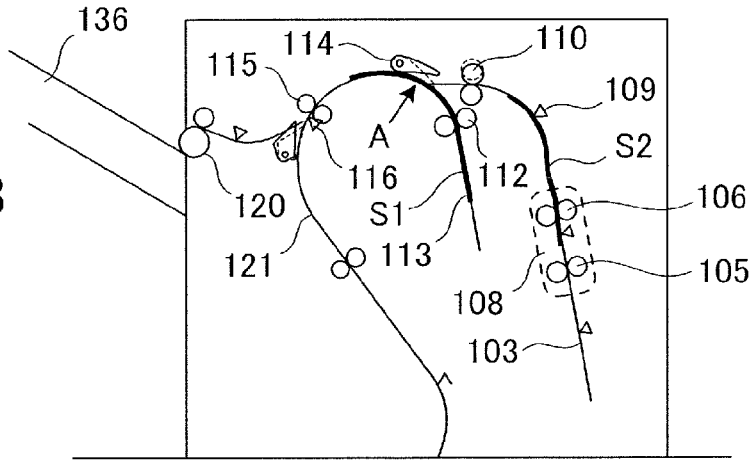
FIG. 7B is a schematic diagram illustrating a second stage of the buffering.
Figure 7C:
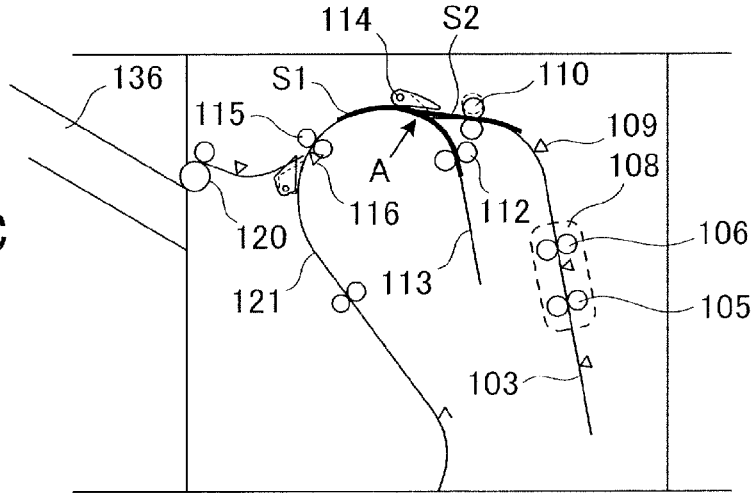
FIG. 7C is a schematic diagram illustrating a third stage of the buffering.

As illustrated in FIG. 7B, the succeeding sheet S2 consecutively conveyed from the copier body 600 after the predetermined sheet interval is fed from the conveyance path 103. Then, as illustrated in FIG. 7C, a leading edge of the succeeding sheet S2 enters the branch portion A and is conveyed so as to overlap over the preceding sheet S by the buffer switch member 114 located at the first position. Then, in a condition in which the leading edge parts of the sheets overlap with a predetermined shift amount, the second buffer roller pair 112 normally rotates to normally convey the preceding sheet S1 toward the stack conveyance path 121. Thereby, the two sheets are conveyed through the stack conveyance path 121 in a overlapped condition overlapping over the predetermined amount such that the succeeding sheet S2 conveyed by the conveyance roller pair 110 is on an upper position and the preceding sheet S1 conveyed by the second buffer roller pair 112 is on a lower position. The sheet bundle (overlapped sheets) is conveyed further through the stack conveyance path 121 toward the stapling processing portion 140 or the saddle processing portion 800.

The shift amount between the leading edges of the preceding and succeeding sheets S1 and S2 may be arbitrarily set by controlling the buffer processing portion 100C such that the second buffer roller pair 112 starts to rotate at a predetermined rotation start timing from when the first buffer sensor 109 detects the leading edge of the succeeding sheet S2. For instance, if the conveyance of the preceding sheet S1 is started again right after when the first buffer sensor 109 is turned ON by the leading edge of the succeeding sheet S2, the overlap amount in the sheet bundle is set small (the shift amount is set large), that is, the preceding sheet S1 largely precedes with respect to the succeeding sheet S2. In contrary, if the re-conveyance timing of the preceding sheet S1 is retarded, the overlap amount in the sheet bundle is set large (the shift amount is set small), that is, the overlap amount of the succeeding sheet S2 with respect to the preceding sheet S1 is set large. If the re-conveyance timing of the preceding sheet S1 with respect to the succeeding sheet S2 is retarded further, they are conveyed by being shifted such that the leading edge of the succeeding sheet S2 precedes over the preceding sheet S1, i.e., such that the succeeding sheet S2 precedes the preceding sheet S1.

It is noted that while the binding process of overlapping two sheets has been described in the embodiment described above, the present disclosure is not limited to such configuration and it is possible to form a sheet bundle in which a plurality of sheets, e.g., three or four sheets, are stuck by retaining two or three sheets in the buffer path 113. In these cases, it is possible to arbitrarily set a sheet overlap amount between the second and third sheets and between an N−1th sheet and an Nth sheet by adjusting the sheet halting timing, similarly to the first sheet and the second sheet.

Figure 8:
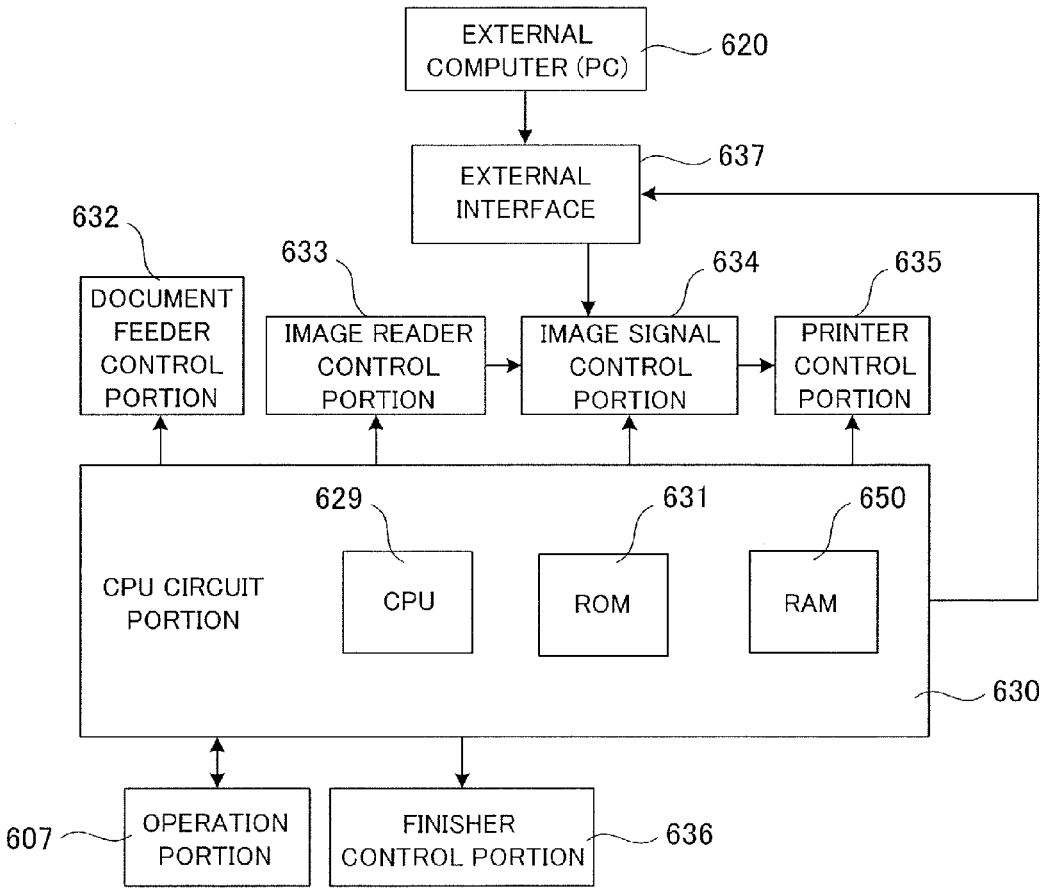
FIG. 8 is a block diagram illustrating a control system of the image forming apparatus.

Next, a control portion of the copier body 600 and the finisher 100 (control portion of the image forming apparatus 1000) will be described. As illustrated in FIG. 8, the copier body 600 of the present embodiment is connected with a computer 620 (external PC) through an external interface 637. A CPU circuit portion 630 includes a CPU 629, a ROM 631 and a RAM 650 and communicates with a document feeder control portion 632, an image reader control portion 633, an image signal control portion 634, and the printer control portion 635. The CPU circuit portion 630 also communicates with an operation portion 607 and a finisher control portion 636.

Figure 9:
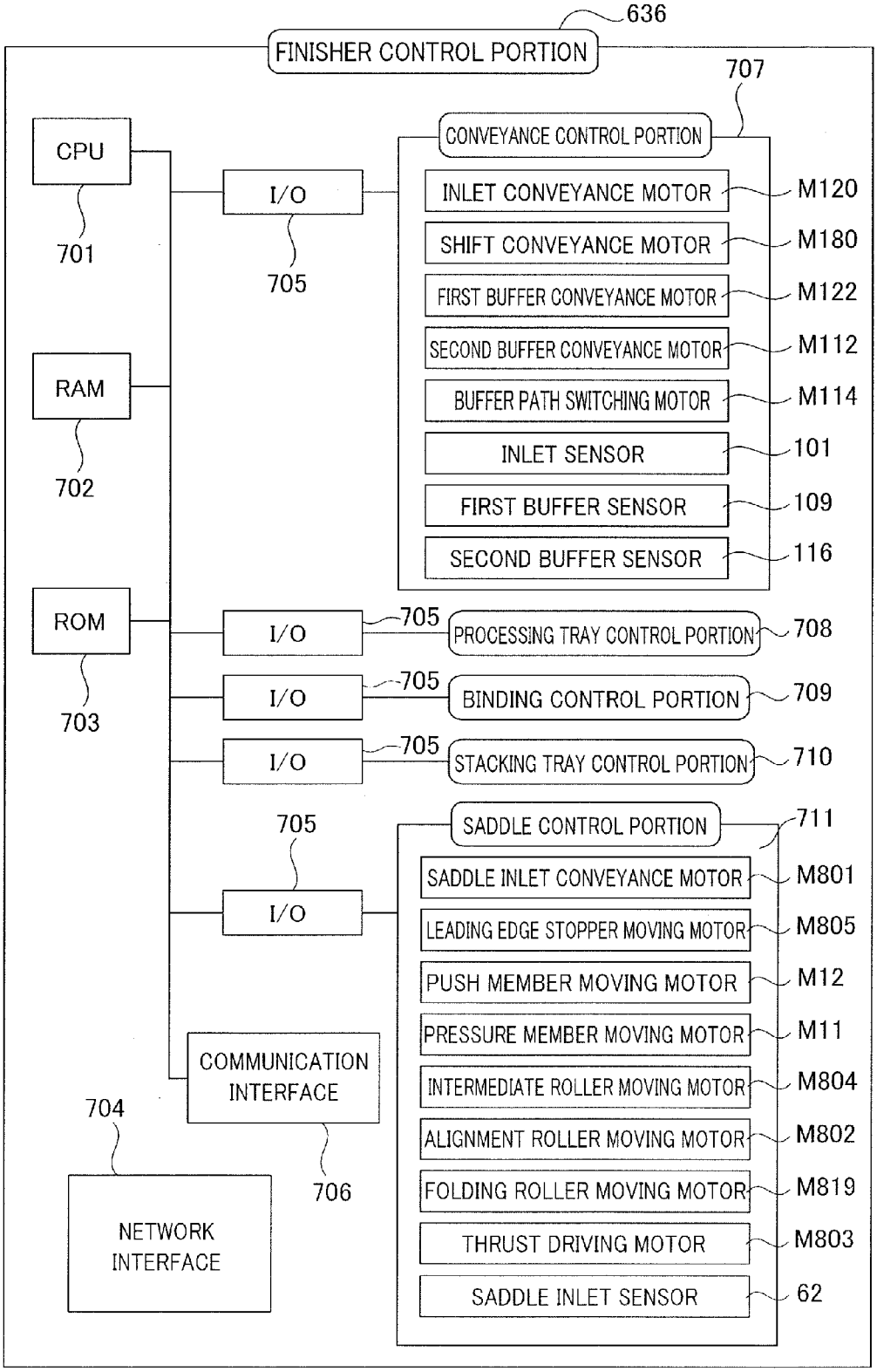
FIG. 9 is a block diagram illustrating a control structure of the finisher.

As illustrated in FIG. 9, the finisher control portion 636 includes a CPU (microcomputer) 701, a RAM 702, a ROM 703, an input/output portion (I/O) 705, a communication interface 706 and a network interface 704. Still further, the input/output portion 705 is connected with a conveyance control portion 707, a processing tray control portion 708, a biding control portion 709, a stacking tray control portion 710, and a saddle control portion 711.

The conveyance control portion 707 receives signals from the inlet sensor 101, the first buffer sensor 109 and the buffer sensor 116. The conveyance control portion 707 also outputs signals to respective motors M120, M180, M122, M112 and M114, each serving as actuators, of an upper discharge roller pair 120, a shift unit 180, a buffer roller pair 122, a second buffer roller pair 112, and a buffer switch member 114.

The saddle control portion 711 receives a signal from the saddle inlet sensor 62. The saddle control portion 711 also outputs signals to respective motors (actuators) M801, M805, M12, M11, M804, and M802 of the inlet roller pair 801, the leading edge stopper 805, the push member 12, the pressure member 11, the intermediate roller 804 and the alignment roller 802. The saddle control portion 711 also outputs signals to respective motors (actuators) M819 and M803 of the folding roller pair 819 and the folding plate 803.

Next, the present embodiment applied to the saddle processing will be described with reference to FIGS. 10A through 12C and to flowcharts in FIGS. 13A and 13B. According to the present embodiment, the sheet bundle overlapped by the buffering process described above is conveyed to the processing tray 15 while maintaining both productivity of the sheet processing and alignment of the sheets.

When a saddle job is inputted, the respective members move to the stand-by positions for accepting the sheet S (see Steps S201 and S202 in FIG. 13). At this time, the alignment plate 815 stands by at a position slightly wider than a sheet width, and the leading edge stopper 805 stands by at the position lower than the stapling position by a half of the sheet length as described above. After that, the sheet passed to the finisher 100 is conveyed to the saddle processing portion 800 through the respective conveyance rollers in Step S203 and undergoes the operations of alignment in the sheet conveyance direction and in the width direction and of the trailing edge sorting in Step S204. The abovementioned operations are conducted to a final sheet of the series of aligned sheet stack of each job in Step S205. Then, a stapling process is carried out by the stapler 820 in Step S206. After the stapling process, the sheet bundle is moved to the position where the middle part of the sheet bundle faces a center of the nip of the folding roller pair 819 and is fed to the nip of the folding roller pair 819 by the thrust action of the folding plate 803 to form a saddle bundle in Steps S207 and S208. Then, in a case when the saddle bundle is a final bundle of the job, i.e., Yes in Step S209, the job ends as it is in Step S215. In a case when there is a next sheet stack to be processed, i.e., No in Step S209, the job enters a ready state to accept a next sheet.

Then, it is judged whether or not a head sheet of a next sheet stack is suitable for buffering in Step S210 based on input information set by the user by operating the operation portion 607. In a case where the sheet should not be buffered, i.e., No in Step S210, a signal to pause the image forming operation is outputted to the copier body 600 (to the image forming apparatus) in Step S211. In this case, the copier body 600 restarts the image forming operation by estimating timing when the saddle processing ends and conveys the sheet on which an image has been formed to the saddle processing portion 800 in Step S203. The sheet mentioned here as not to be buffered includes a case of a thick sheet whose grammage is 300 g/m$^2$ for example, i.e., a case when conveyance resistance against each motor of the conveyance rollers exceeds a rated torque in conveying overlapped sheets (sheet bundle) through the conveyance path or a case when a conveyance force of each motor is insufficient. It is noted that while it is confirmed whether or not the head sheet of the next sheet stack is suitable for buffering after completing the saddle bundle processing in FIG. 13A for the convenience of the flowchart, actually information may be exchanged between the finisher and the image forming apparatus during the previous sheet bundle processing to determine whether or not the buffering operation is to be carried out, i.e., whether or not the pausing of the image forming operation occurs.

In other words, Step S210 is a step for selecting a first conveyance process of conveying sheets in a form of the sheet bundle to the sheet supporting portion via the buffer processing portion and a second conveyance process of conveying the sheets one by one to the sheet supporting portion without forming the sheet bundle by the buffering process. Then, the conveyance control portion 707 executes the first conveyance process in conveying a sheet having a first thickness and the second conveyance process in conveying a sheet having a second thickness. Because it is not necessary to pause the image forming operation of the copier body 600 in the case of the second conveyance process, it is possible to improve the productivity as compared to the case of the first conveyance process.

Figure 15A:
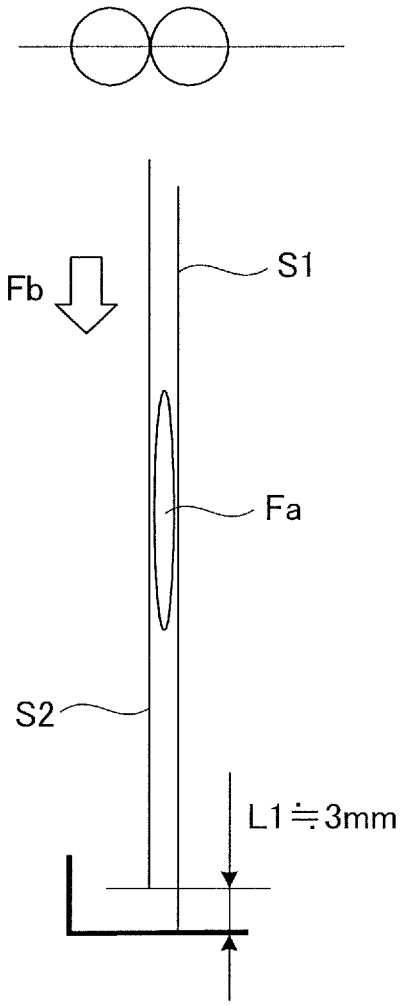
FIG. 15A is a diagram illustrating a conventional buffered sheet aligning operation.
Figure 15B:
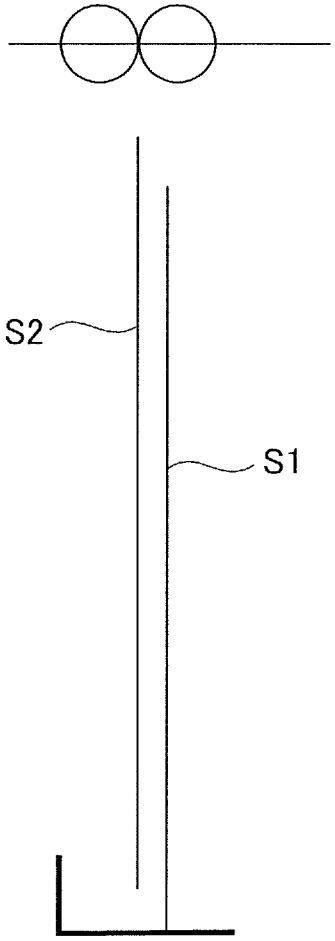
FIG. 15B is another diagram illustrating the conventional buffered sheet aligning operation.

In a case when the head sheet of the next sheet stack is suitable for buffering, i.e., Yes in Step S210, it is confirmed whether or not the sheet is a high smoothness sheet based on the input information such as a type of the sheet set by the user in Step S212. The high smoothness sheet is a sheet whose surface is highly smooth such as a coated sheet, a film sheet and an OHP sheet. In the case of the high smoothness sheet, a high pasting force Fa is generated between the buffered sheets as illustrated in FIG. 15. Therefore, in the case of the high smoothness sheet, i.e., Yes in Step S212, the conveyance control portion 707 sets and controls timing of sending a re-start signal to the second buffer conveyance motor M112 after when the first buffer sensor 109 detects the leading edge of the succeeding sheet in the buffer processing portion 100C. Thereby, the conveyance control portion 707 sets such that a buffering shift amount L1 is larger than a distance L2 from the trailing edge (other end) of the preceding sheet to the inlet roller when one end of the preceding sheet abuts against the leading edge stopper 805, i.e., such that L1>L2 in Step S213.

Figure 10A:
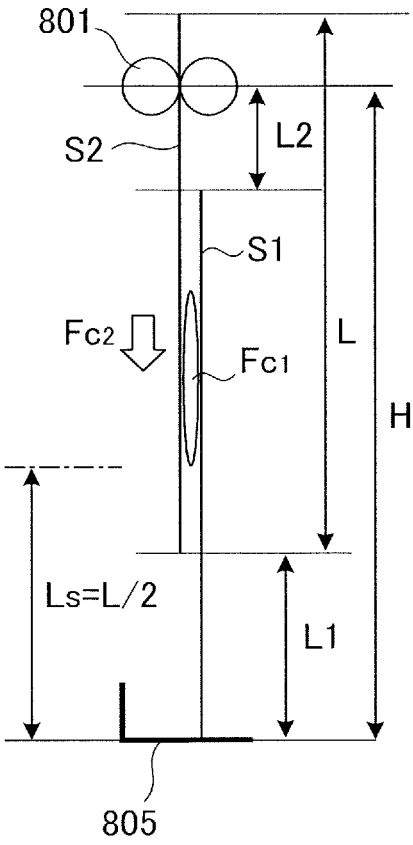
FIG. 10A is a diagram illustrating a first buffered sheet aligning operation of the saddle processing portion.
Figure 10B:
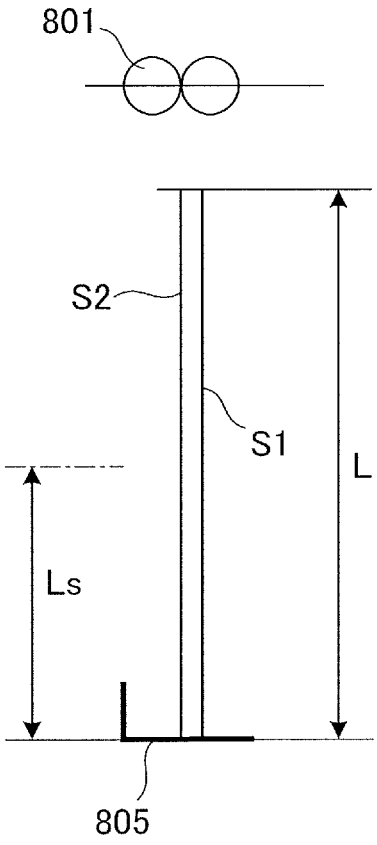
FIG. 10B is a diagram illustrating a state of the saddle processing portion after executing the buffered sheet aligning operation.

That is, as illustrated in FIG. 10A, the shift amount L1 of the preceding sheet S1 is set to be larger than the distance L2 from the trailing edge of the preceding sheet S1 to the inlet roller pair 801 in a state when the preceding sheet S1 abuts against the leading edge stopper 805, i.e., L1>L2. In this situation, a relationship of L<H<L+L1 holds, where H is a distance from the inlet roller pair 801 to the leading edge stopper 805 in the sheet conveyance direction, and L is a sheet length. In detail, with reference also to FIG. 13B, after when the preceding sheet S1 passes through the inlet roller pair 801 in Step S204*a* and abuts against the leading edge stopper 805 in Step S204*b*, a separation force Fc2 is generated as the trailing edge of the succeeding sheet S2 is conveyed further by the inlet roller pair 801. It is possible to separate the buffered sheets and to convey in the conveyance direction by making the separation force (alignment force) Fc2 exceed the pasting force Fc1 in Step S204*c*. As illustrated in FIG. 10B, among the buffered sheets S1 and S2, the succeeding sheet S2 is forcibly conveyed into the path by the inlet roller pair 801 (conveyance roller pair) in a condition in which the preceding sheet S1 is in contact with the leading edge stopper 805. Thereby, the succeeding sheet S2 is released such that the leading edge thereof abuts against the leading edge stopper 805 by inertia, and the both sheets S1 and S2 abut against and aligned by the leading edge stopper 805. After thus completing the alignment in the conveyance direction of the buffered sheets S1 and S2, the alignment in the width direction and the trailing edge sorting are carried out in the same manner with the sheet processing of the first part (first sheet bundle) described above in Step S204*d*. Thus, it is ready to accept a next sheet. The alignment and the trailing edge sorting are carried out on a sheet S3 (third sheet of the second part) after that and on a sheet SN (final sheet of the second part) in the same manner with that carried out on the first stack, and a saddle bundle is formed by conducting the stapling process and the thrusting and folding operation. This operation is conducted until a final sheet bundle is formed and then the job ends in Step S215.

Thus, the sheet processing method of the present embodiment includes the overlap processing step of making the sheets overlap each other in Step S213, the aligning step of aligning the overlapping sheet bundle in Steps S203 and S204, and the processing step of processing the aligned sheet bundle by the stapling process or the like in Step S206. In particular, the aligning step includes a separation step of forcibly conveying the succeeding sheet S2 by the inlet roller pair 801 in a condition in which the trailing edge of the preceding sheet S1 is discharged from the inlet roller pair 801 and the leading edge of the preceding sheet S1 is in contact with the leading edge stopper 805 in Step S204*c*. This separation step enables the succeeding sheet S2 to move relatively with respect to the preceding sheet S1 and is smoothly aligned even if the sheets are high smoothness sheets.

It is noted that as long as the inlet roller pair 801 forcibly conveys the succeeding sheet S2 in the condition in which the leading edge of the preceding sheet S1 is in contact with the leading edge stopper 805, it is possible to arrange such that shift amount L1=distance L2 (distance H=sheet length L+shift amount L1). However, in a case of taking a tolerance of the sheet length and variation of the conveyance speed into account, it is preferable to set L1 to be larger than L2 so that the forcible conveyance of the succeeding sheet S2 is stably executed.

Still further, while the amount of the buffer shift amount L1 is controlled corresponding to the smoothness of the sheet in the present embodiment, it is also possible to set such that L1>L2 if there is a possibility that the pasting force between the sheets is high. For instance, it is conceivable to control such that the buffer shift amount is L1>L2 in a case when humidity is high, an output image is a uniform image (solid image), or a gloss processing is implemented on an output image by a transparent toner or the like.

Figure 11A:
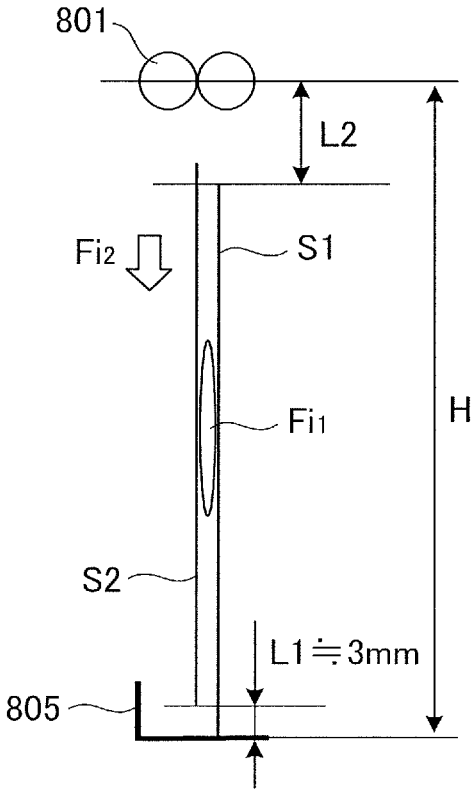
FIG. 11A is a diagram illustrating a second buffered sheet aligning operation of the saddle processing portion.
Figure 11B:
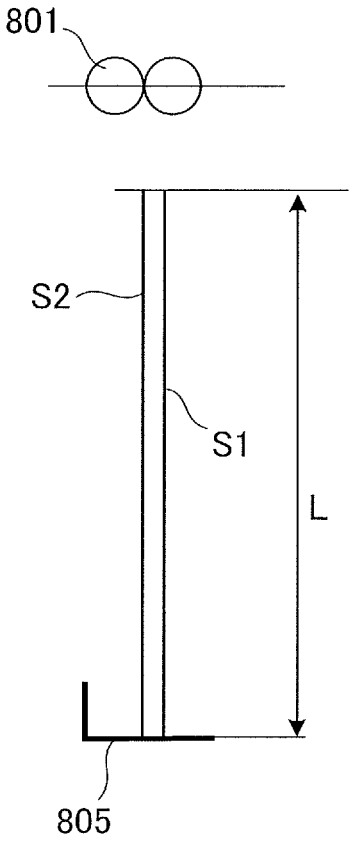
FIG. 11B is a diagram illustrating a state of the saddle processing portion after executing the buffered sheet aligning operation.

Meanwhile, in a case when a head sheet of the next sheet stack is not a high smoothness sheet, i.e., No in Step S212, the buffer shift amount is set to be about 3 mm as illustrated in FIG. 11A in Step S214. Because the pasting force Fi1 is small in the case when the sheet is not the high smoothness sheet, even the aligning force Fi2, i.e., the inertia of the succeeding sheet S2, exceeds the pasting force Fi1 and alignment of the sheet in the conveyance direction is achieved. That is, in the state in which the leading edge of the preceding sheet S1 is in contact with the leading edge stopper 805, the succeeding sheet S2 is also released by the inertia so as to abut against the leading edge stopper 805 even if the trailing edge of the succeeding sheet S2 is discharged from the inlet roller pair 801. Thereby, the buffer sheets S1 and S2 are aligned as illustrated in FIG. 11B. After that, a saddle bundle is formed until a final sheet of a final bundle is processed similarly to the case of the high smoothness sheet, and the job is finished.

It is thus possible to align the both sheets by setting such that L1>L2 in the case of the high smoothness sheet and such that L1 is about 3 mm in the case when the sheet is not the high smoothness sheet. Because the larger the buffering shift amount L1, the shorter the inter-stack time in the case of not the high smoothness sheet, it is desirable to set the shift amount L1 around a small value of about 3 mm. While the buffer shift amount is desirable to be small of about 3 mm from an aspect of improvement of productivity, such a small shift amount is not suitable in the case of the high smoothness sheet because the pasting force Fc1 becomes great and the separation force of the inertia falls under the pasting force Fc1, which situation may cause alignment failure. In contrast, it is possible to generate a large separation force Fc2 by a conveyance force of the inlet roller pair 801 by setting the buffering shift amount L1 such that L1>L2 and to achieve the alignment for the first time by setting as Fc2>Fc1.

That is, in the case of the high smoothness sheet, it is suitable to be L1>L2 from the aspect of alignment. In the case of not the high smoothness sheet, while either cases of L1>L2 and L1=3 mm are permissible, it is desirable to set to be L1=3 mm from an aspect of assuring the sheet inter-stack time.

That is, Step S212 is a step of recognizing whether or not the sheet is the high smoothness sheet. In other words, the Step S212 is a step of switching a process of the control portion such that the shift amount L1 is set to a predetermined amount to hold the relationship of L1>L2 in the case when the sheet is the high smoothness sheet and a shift amount L1 is set smaller than the predetermined shift amount when the sheet is not the high smoothness sheet.

As a method of setting to be L1>L2 as described above, there is also a method of adjusting a moving position of the leading edge stopper 805, besides the method of adjusting the buffering shift amount L1. That is, this is a method of moving the leading edge stopper 805 such that the value of the distance H meets the relationship of L<H≤L+L1 about the sheet length L and the distance H from the inlet roller pair 801 to the leading edge stopper 805. This method also realizes the state in which the succeeding sheet S2 is conveyed by the inlet roller pair 801 when the leading edge stopper 805 rises with respect to the preceding sheet S1 and the leading edge of the preceding sheet S1 abuts against the leading edge stopper 805. In this case, it is necessary to move the leading edge stopper 805 such the stapler 820 corresponds to a position of a half of a sheet length in saddle stitching the sheet on the processing tray at a middle part of the sheet length. Therefore, this operation may become cumbersome, and when a number of sheets of the saddle stitching sheet stack is less, the moving time of the leading edge stopper 805 is added to the binding process of the stapler, thus there is a small chance of dropping of the productivity.

Figure 12A:
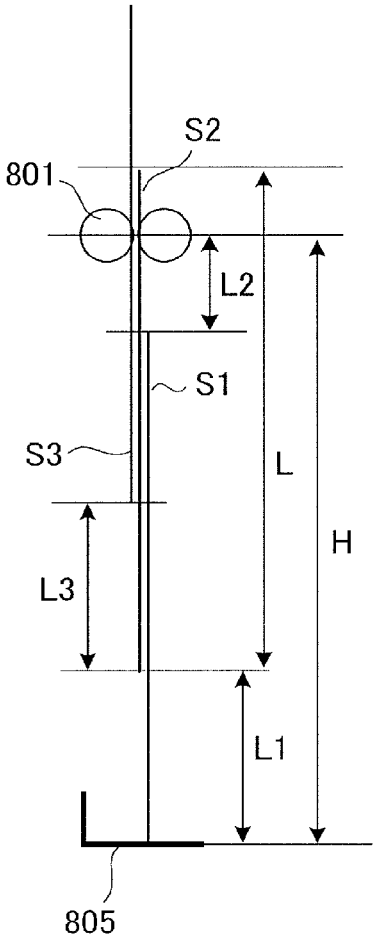
FIG. 12A is a diagram illustrating an initial stage of a third buffered sheet aligning operation of the saddle processing portion.

While the operation of buffering two sheets has been described above and the shift amount L1 between the first and second sheets has been set to be larger than L2 as illustrated in FIG. 12A. Still further, it is possible to buffer and align three or more sheets by setting a shift amount L3 between the second and third sheets to be larger than a distance L4 from the trailing edge of the succeeding sheet S2 to the inlet roller pair 801 when the succeeding sheet S2 abuts against the leading edge stopper 805 (see FIG. 12C). In this case, because the distances L2 and L4 are equal unless the leading edge stopper 805 is moved during the stacking the buffer sheets, the shift amounts L1 and L3 are also equal.

Figure 14:
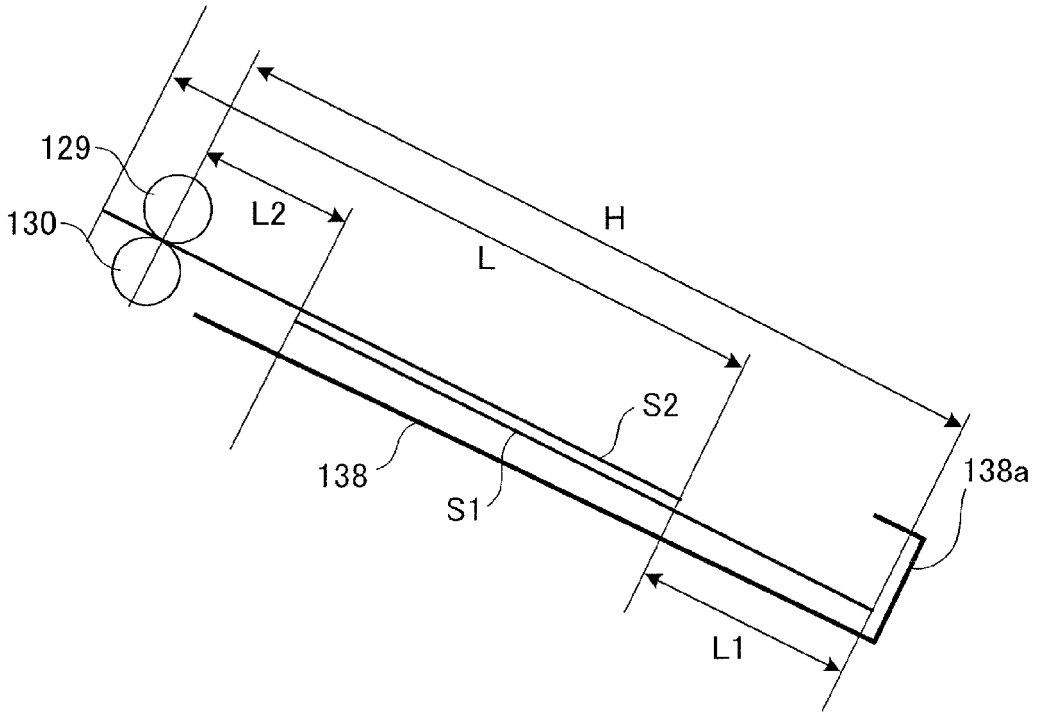
FIG. 14 is a diagram illustrating a buffered sheet aligning operation of a processing tray of a different embodiment.

While the sheet is drawn to move in the vertical direction in FIGS. 10A through 12C, actually, the processing tray 15, i.e., the sheet supporting portion, is composed of the inclined surface of a steep gradient as illustrated in FIGS. 3 through 6E. In FIGS. 10A through 12C, the right side is a stacking surface (supporting surface) of the processing tray and the sheet is stacked and aligned on the stacking surface. While a processing tray 138 (supporting portion) of a staple processing portion described later with reference to FIG. 14 is also the same, the preceding sheet S1 among the sheet bundle formed in the buffer processing portion is conveyed precedingly out of the inlet roller pair 801 and is stacked on the stacking surface of the processing tray. The succeeding sheet is conveyed out of the inlet roller pair 801 behind the preceding sheet and is stacked on the preceding sheet.

Figure 12B:
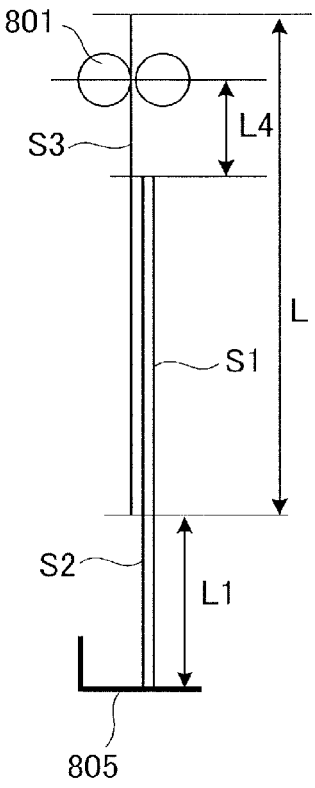
FIG. 12B is a diagram illustrating an intermediate stage of the buffered sheet aligning operation.
Figure 12C:
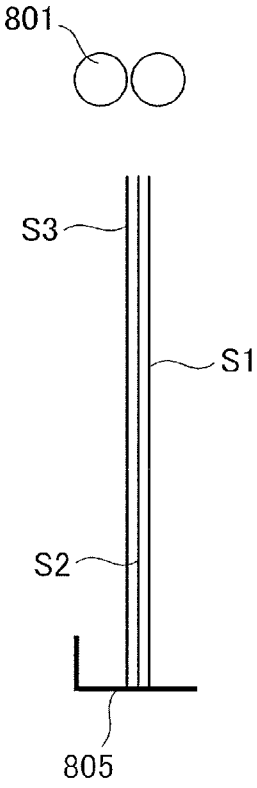
FIG. 12C is a diagram illustrating a state of the saddle processing portion after executing the buffered sheet aligning operation.
Figure 13B:
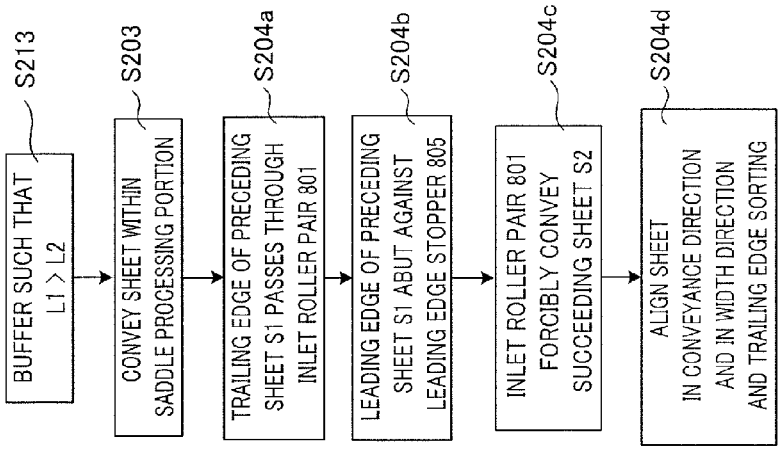
FIG. 13B is a flowchart illustrating a sheet aligning process in processing a high smoothness sheet.
Figure 13A:
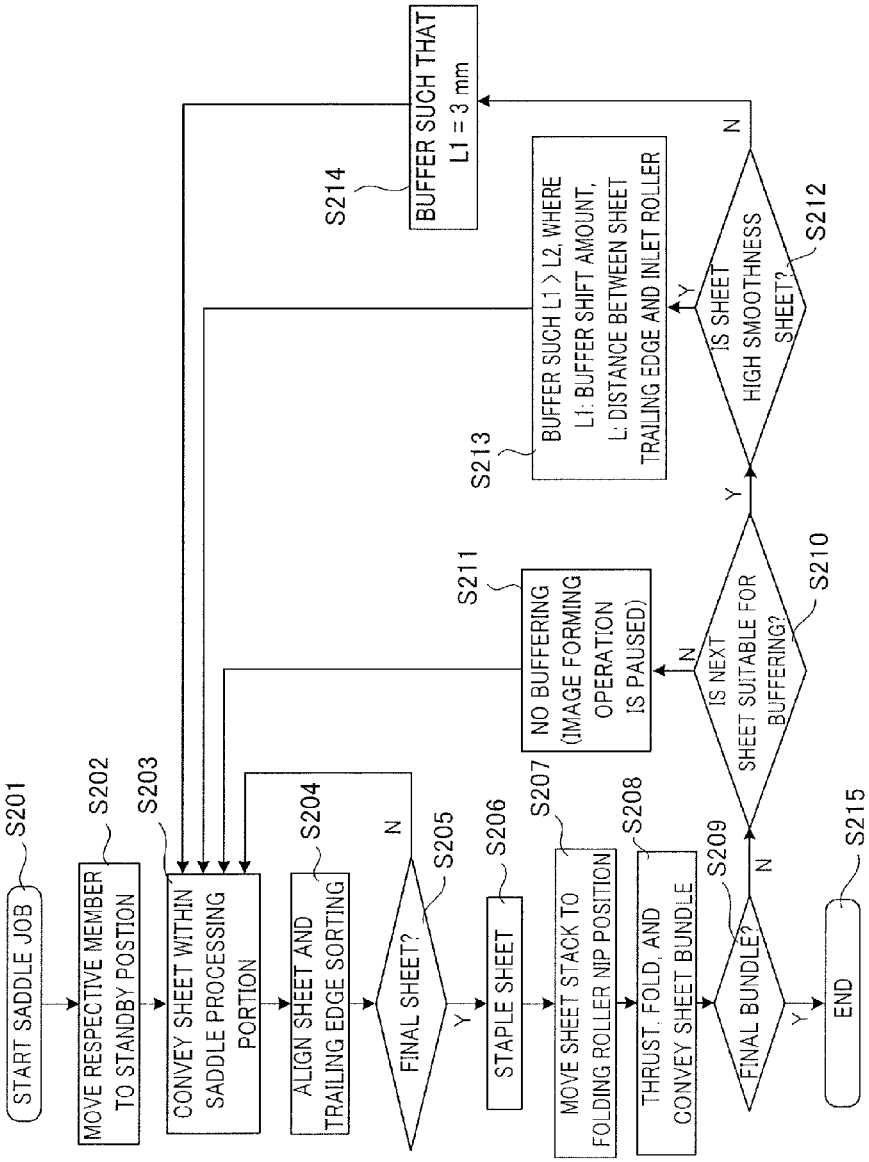
FIG. 13A is a flowchart illustrating a control process of the finisher.

As illustrated in FIGS. 12A through 12C, the same applies to the case of three or more sheets, and the second sheet S2 becomes a succeeding sheet relatively with respect to the first sheet S1 and becomes a preceding sheet relatively with respect to the third sheet S3. Thus, the sheet bundle formed in the buffer processing portion includes two more sheets of the preceding sheet retained in advance and the succeeding sheet relatively succeeding the preceding sheet. The conveyance roller pair conveys the preceding sheet such that the preceding sheet precedes relatively the succeeding sheet. On the sheet supporting portion, the preceding sheet is stacked on the sheet supporting portion at a relatively close position to the supporting surface with respect to the succeeding sheet.

As described above, because the leading edge stopper 805 is located at the position lower than the stapling position by a half of a sheet length (Ls=L/2), a distance L2 between a trailing edge of a sheet and the inlet roller pair 801 varies depending on the length of the sheet. Therefore, the buffer shift amount L1 needs to be set at a different value depending on the sheet length. The control portion recognizes the sheet size by the setting made by the user through the operation portion 607 or by timing of detection of the first and second buffer sensors 109 and 116. That is, the operation portion 607 and the first and second buffer sensors 109 and 116 are one example of a sheet size detection portion capable of detecting the sheet size. Based on the recognition of the sheet size, the control portion adjusts the position of the leading edge stopper 805 and relatively changes the distance between L1 and L2 based on the sheet size such that the relationship of L1>L2 is held.

The inertia alignment method of aligning the sheets by inertia by releasing the sheet by the conveyance roller pair (inlet roller pair) on the processing tray whose angle is steep close to verticality, like the saddle processing, has been applied in the abovementioned description. Then, an embodiment applied to an alignment method realized by a sliding alignment member such as a paddle will be described with reference to FIGS. 2 and 14.

The present embodiment is applied to the stapling processing portion 140 illustrated in FIG. 2. The buffered sheet bundle S1 and S2 are discharged out of a discharge roller 128 of the stapler path 126 to the processing tray 138 with a moderate inclination angle close to horizontality.

At this time, an upper roller 129 is located upward at an open position, and the sheet bundle is discharged out of the discharge roller 128 onto the processing tray 138 while reversing (replacing) its leading edge and trailing edge. The upper roller 129 and a lower roller 130 receive the sheet bundle discharged out of the discharge roller 128. After conveying the received sheet bundle by nipping and by rotating normally, the upper roller 129 and the lower roller 130 rotate reversely. When the upper roller 129 and the lower roller 130 rotate reversely, the sheet bundle is conveyed by the upper roller 129 and the lower roller 130 toward a leading edge stopper 138*a*, i.e., an end regulation member, by setting the trailing edge of the sheet bundle until then as a head (leading edge). It is noted that as illustrated in FIG. 2, the sheet heading onto the processing tray 138 is lead such that the head, i.e., an end on the side of the sheet bundle abutting against the leading edge stopper 138*a*, is guided by the knurled belt 158 onto the processing tray 138. The sheet conveyed toward the leading edge stopper 138*a* is conveyed by the paddle 131 on the processing tray 138 toward the leading edge stopper 138*a* such that the end of the sheet abuts against the leading edge stopper 138*a*. After when the end of the sheet abuts against the leading edge stopper 138*a*, the paddle 131 slides on an upper surface of the sheet.

In this case, the buffered sheets have been made to overlap each other such that the leading edge of the succeeding sheet S2 precedes the leading edge of the sheet S by a predetermined amount L1 in the buffer processing portion 100C. It is noted that because lengths of the preceding sheet S1 and the succeeding sheet S2 are equal and the leading and trailing edges of the sheets are reversed on the processing tray 138, the leading edge of the preceding sheet S1 (an end to abut against the leading edge stopper 138*a*) precedes by the predetermined amount L1.

The sheet bundle of sheets S1 and S2 discharged out of the discharge roller 128 onto the processing tray 138 are discharged while positioning the preceding sheet S1 at a lower position and the succeeding sheet S2 at an upper position on the processing tray 138 inclined moderately. Then, the paddle 131 comes into contact with the succeeding sheet S2 on the upper side, and the leading edge of the preceding sheet S1 on the lower side preceding by the predetermined shift amount L1 abuts against the leading edge stopper 138*a*. Because the large pasting force (Fc1: see FIG. 10A) acts between the sheets S1 and S2 of the sheet bundle, there is a case when the sheets is not separated by a separation force of the paddle 131.

In the present embodiment, in contrast, the upper roller 129, i.e., an opening/closing roller, moves to a close position and forms a conveyance roller pair nipping the sheet with the lower roller 130. Meanwhile, a distance L2 between the trailing edge of the preceding sheet S1 and the nip of the roller pair of the upper roller 129 and the lower roller 130 is set to a value smaller than the predetermined shift amount L1 in the state in which the leading edge of the preceding sheet S1 is in contact with the leading edge stopper 138*a*. To that end, the predetermined shift amount L1 and a distance between the roller pair 129 and 130, i.e., a conveyance roller pair, are set in advance. Accordingly, similarly to the saddle processing described above, a conveyance force of the roller pair 129 and 130 surpasses the pasting force and the succeeding sheet S2 is forcibly conveyed. In a state in which the trailing edge of the succeeding sheet S2 is released from the conveyance roller pair 129 and 130, the succeeding sheet S2 is pulled back by the paddle 131 and abuts against the leading edge stopper 138*a*. Thereby, the buffered sheets are aligned in the conveyance direction and a succeeding sheet succeeding to the buffered sheets is also aligned respectively by the paddle 131 and others. The buffer sheet is aligned widthwise by a side end aligning portion not illustrated, and the aligned sheet stack is stapled by the stapler 132. The sliding alignment member is not limited to be the paddle and other members such as a knurled belt is applicable in the same manner.

It is noted that the mode of conducting the buffering process such that a next sheet does not go to the processing portion during the binding process or the saddle stitching and double folding process of the preceding sheet has been exemplified in the embodiment described above. However, the process of the preceding sheet is not limited only to be binding or folding. For instance, the technique of the present disclosure is also applicable to such a buffer unit as to retain succeeding sheets and hold not to be conveyed to a processing portion during the preceding sheets are aligned in the width direction at the processing portion.

It is noted that it is possible to apply the sheet bundle alignment method of the relationship of L1>L2 described above to all alignment methods, not only to the inertia alignment method and the alignment method by means of the slide returning member such as the paddle. Still further, all kinds of binding process such as one adopting a buffer roller capable of winding up a sheet, besides one adopting the buffer path of the present embodiment, is applicable as the binding process. The sheet processing of the present embodiment is applicable also to all kinds of processes, besides the saddle processing and the staple processing described above.

OTHER EMBODIMENTS

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-154003, filed on Aug. 4, 2015, which is hereby incorporated by reference herein in its entirety.

What is claimed is:

1. A sheet processing apparatus comprising:

a sheet overlap processing portion configured to form a sheet bundle in which a plurality of sheets to be processed overlap each other while being shifted from each other;

a conveyance roller pair configured to convey the sheet bundle formed by the sheet overlap processing portion;

a sheet supporting portion supporting the sheet bundle conveyed by the conveyance roller pair;

an end regulation member configured to abut with and regulate a downstream end, in a conveyance direction of the conveyance roller pair, of the sheet bundle supported on the sheet supporting portion; and a control portion configured to control a distance H and/or a shift amount L1 such that a relationship of $L<H\leq L+L1$ holds, where L is a length of each sheet among the sheet bundle in the conveyance direction, H is a distance from the conveyance roller pair to the end regulation member in the conveyance direction, and L1 is a shift amount between a first sheet among the sheet bundle and a second sheet adjacent to the first sheet among the sheet bundle.

2. The sheet processing apparatus according to claim 1, wherein the control portion is configured to control the distance H and/or the shift amount L1 such that a relationship of L1>L2 holds, where L2 is a difference between the distance H and the sheet length L.

3. The sheet processing apparatus according to claim 1, wherein the first sheet precedes the second sheet in the conveyance direction, and wherein the first sheet is stacked on the sheet supporting portion while being positioned closer to a supporting surface of the sheet supporting portion than the second sheet.

4. The sheet processing apparatus according to claim 1, wherein the control portion is configured to execute (i) a first conveyance process in which the plurality of sheets are formed into the sheet bundle by the sheet overlap processing portion and conveyed to the sheet supporting portion and (ii) a second conveyance process in which the plurality of sheets are conveyed one by one to the sheet supporting portion without being formed into the sheet bundle by the sheet overlap processing portion.

5. The sheet processing apparatus according to claim 4, wherein the control portion executes the first conveyance process in conveying sheets having a first thickness and executes the second conveyance process in conveying sheets having a second thickness thicker than the first thickness.

6. The sheet processing apparatus according to claim 1, wherein the control portion controls the distance H and/or the shift amount L1 such that a relationship of H<L+L1 holds if the sheet is a high smoothness sheet and such that a relationship of H>L+L1 holds if the sheet is not the high smoothness sheet.

7. The sheet processing apparatus according to claim 6, further comprising an operation portion through which a type of a sheet is inputted, wherein the control portion controls at least one of the distance H and/or the shift amount L1 based on information inputted through the operation portion.

8. The sheet processing apparatus according to claim 1, further comprising a sheet size detection portion configured to detect a sheet size, wherein the control portion controls the distance H based on the sheet size.

9. The sheet processing apparatus according to claim 1, wherein the control portion controls the shift amount L1 among the sheets in the sheet overlap processing portion.

10. The sheet processing apparatus according to claim 1, wherein the control portion sets the distance H by controlling a position of the end regulation member from the conveyance roller pair.

11. The sheet processing apparatus according to claim 1, wherein the sheet overlap processing portion comprises a first roller pair disposed on a downstream conveyance path disposed downstream of an upstream conveyance path and upstream of the sheet supporting portion, the first roller pair being configured to rotate normally and reversely, and a second roller pair disposed on a branch path branched from a branch portion between the upstream conveyance path and the downstream conveyance path, a second roller pair being configured to rotate normally and reversely, and wherein the sheet overlap processing portion retains the first sheet in the branch path to overlap with the second sheet conveyed from the upstream conveyance path.

12. The sheet processing apparatus according to claim 11, further comprising a sensor configured to detect a sheet passing through the conveyance path, wherein the control portion controls the sheet overlap processing portion such that the first sheet is passed from the upstream conveyance path into the downstream conveyance path, the first roller pair is reversely rotated after when an upstream end in the conveyance direction of the first sheet passes through the branch portion, the first roller pair stops after the first sheet is sent to the branch path through the branch portion, and the second roller pair starts to rotate after the sensor detects the second sheet in the conveyance path so that the first sheet and the second sheet are conveyed to the stack conveyance path while overlapping each other, and wherein the control portion sets the shift amount L1 by controlling a time difference from the detection of the second sheet by the sensor to the start of the rotation of the second roller pair.

13. The sheet processing apparatus according to claim 1, wherein the sheet supporting portion is inclined with an approximately vertical angle; and wherein the end regulation member abuts with and keeps the downstream ends in the conveyance direction of the first and second sheets from moving downward.

14. The sheet processing apparatus according to claim 13, further comprising:

a push member configured to move the sheet released from the conveyance roller pair toward a support surface of the sheet supporting portion, the conveyance roller pair being disposed separately from the support surface in a direction vertical to the support surface; and a pressure member configured to press an upstream end in the conveyance direction of the sheet moved by the push member.

15. The sheet processing apparatus according to claim 14, further comprising:

a stapler configured to bind a middle part of the sheet bundle supported on the sheet supporting portion and aligned by the end regulation member;

a folding plate configured to thrust and fold the middle part of the sheet bundle bound by the stapler;

a folding roller pair gripping and conveying the sheet bundle folded in two by the folding plate; and a moving mechanism moving the end regulation member to an upper position and a lower position along the sheet supporting portion, wherein the sheet bundle on the sheet supporting portion is aligned by abutting with the end regulation member and bound by the stapler in a state in which the end regulation member is located at the upper position, and the sheet bundle is folded by the folding plate and the folding roller pair after the end regulation member is moved from the upper position to the lower position.

16. The sheet processing apparatus according to claim 1, further comprising:

a discharge roller pair configured to discharge the sheet bundle toward the sheet supporting portion inclined with an approximately horizontal angle such that a downstream end in the conveyance direction of the sheet bundle conveyed by the conveyance roller becomes a trailing edge; and a sliding alignment portion disposed on the sheet supporting portion, the sliding alignment portion being configured to convey the sheet such that the downstream end in the conveyance direction of the sheet bundle on the sheet supporting portion abuts against the end regulation member while sliding on an upper surface of the sheet, wherein the conveyance roller pair is composed of a lower roller disposed on the sheet supporting portion and an upper roller driven to open/close with respect to the lower roller, and wherein the lower and upper rollers nip and convey the sheet bundle discharged out of the discharge roller pair on the sheet supporting portion and the sliding alignment portion conveys the sheet bundle toward the end regulation member to align the sheet bundle such that a leading edge opposite to the trailing edge of the sheet bundle abut against the end regulation member.

17. The sheet processing apparatus according to claim 16, further comprising a stapler disposed on a downstream side of the sheet supporting portion, the stapler being configured to bind sheets aligned on the sheet supporting portion.

18. The sheet processing apparatus according to claim 1, wherein the sheet overlap processing portion is configured to form the sheet bundle in which three or more sheets overlap each other and are shifted sequentially in the conveyance direction, wherein the control portion controls the distance H and/or the shift amount L3 such that a relationship of $L<H\leq L+L3$ holds on each set of adjacent sheets, where L3 is a shift amount between the adjacent sheets among the sheet bundle.

19. An image forming apparatus comprising:

a sheet processing apparatus as set forth in claim 1; and an image forming apparatus body comprising an image forming portion and configured to form an image on a sheet, wherein the sheet on which the image has been formed by the image forming apparatus body is conveyed to the sheet processing apparatus to be processed.

* * * * *